US006064050A

United States Patent [19]

Ishikawa et al.

[11] Patent Number: 6,064,050

[45] Date of Patent: May 16, 2000

[54] COOKING APPARATUS SEQUENTIALLY DISPLAYING COOKING METHODS ON ITS DISPLAY AND COOKING METHODS USING SUCH COOKING APPARATUS

[75] Inventors: Kazuhiko Ishikawa; Kazuo Wanda, both of Nara, Japan

[73] Assignee: Sharp Kabushiki Kaisha, Osaka, Japan

[21] Appl. No.: 08/890,559

[22] Filed: Jul. 9, 1997

[30] Foreign Application Priority Data

| | | | |
|---|---|---|---|
| Jul. 10, 1996 | [JP] | Japan | 8-180680 |
| Jul. 29, 1996 | [JP] | Japan | 8-199089 |
| Jul. 29, 1996 | [JP] | Japan | 8-199092 |
| Jul. 29, 1996 | [JP] | Japan | 8-199103 |
| Jul. 29, 1996 | [JP] | Japan | 8-199105 |

[51] Int. Cl.[7] ..... H05B 6/68

[52] U.S. Cl. ..... 219/720; 219/506; 219/702; 99/325

[58] Field of Search ..... 219/720, 702, 219/506; 99/DIG. 14, 325

[56] References Cited

U.S. PATENT DOCUMENTS

| | | | |
|---|---|---|---|
| 4,447,692 | 5/1994 | Mierzwinski . | |
| 4,568,810 | 2/1986 | Carmean . | |
| 4,625,086 | 11/1986 | Karino | 219/720 |
| 4,933,527 | 6/1990 | Edamura | 219/720 |
| 5,183,984 | 2/1993 | Nakagawa | 219/720 |
| 5,221,817 | 6/1993 | Ota | 219/720 |
| 5,317,134 | 5/1994 | Edamura | 219/720 |

FOREIGN PATENT DOCUMENTS

| | | | |
|---|---|---|---|
| 2040992 | 10/1991 | Canada . | |
| 2053830 | 4/1992 | Canada . | |
| 03 29111A2 | 8/1989 | European Pat. Off. . | |
| 03 66137A1 | 5/1990 | European Pat. Off. . | |
| 04 32080A2 | 6/1991 | European Pat. Off. . | |
| 04 54143A2 | 10/1991 | European Pat. Off. . | |
| 04 98669A1 | 8/1992 | European Pat. Off. . | |
| 58-175730 | 10/1983 | Japan | 219/720 |
| 59200125 | 11/1984 | Japan . | |
| 63-60802 | 4/1988 | Japan . | |
| 1-19229 | 1/1989 | Japan | 219/720 |
| 3-67928 | 3/1991 | Japan | 219/720 |
| 4-103920 | 4/1992 | Japan | 219/720 |
| 22 64370 | 8/1993 | United Kingdom . | |

*Primary Examiner*—Philip H. Leung

[57] ABSTRACT

A cooking apparatus includes an external memory for storing methods of cooking various dishes, genre keys to specify one out of a plurality of large groups of cooking methods produced by specifying cooking methods stored in external memory depending upon the kind of cooking, a liquid crystal display for displaying items corresponding to the one group of cooking methods specified by the genre key, select keys for selecting one out of items corresponding to the one group of cooking methods displayed on liquid crystal display, and a microcomputer for controlling a cooking operation based on the item selected by select key.

17 Claims, 52 Drawing Sheets

FIG.6

| NO. | 1 | 2 | 3 | 4 | 5 | 6 | 7 | 8 | 9 |
|---|---|---|---|---|---|---|---|---|---|
| OPERATIONS | MANUAL<br>MANUAL<br>MICROWAVE ●<br>OVEN ○<br>GRILL ○<br>TOASTER ○<br>STEW ○ | MICROWAVE<br>MICROWAVE<br>500 W ↓ ○<br>MIN SEC<br>1 MIN ○<br>10 SEC ●<br>ROUND PLATE | MICROWAVE<br>500 W ↓ ○<br>10 MIN 00 SEC<br>1 MIN ○<br>10 SEC ○<br>ROUND PLATE | START<br>MICROWAVE<br>500 W<br>X MIN XX SEC | MICROWAVE<br>500 W<br>X MIN XX SEC ○<br>CHANGED | FINISHED<br>EXTENSION ● | EXTENDED<br>EXTENDED<br>500 W<br>0 SEC<br>1 MIN ●<br>10 SEC ○<br>ROUND PLATE | 1 MIN<br>EXTENDED<br>500 W<br>1 MIN 00 SEC<br>1 MIN ○<br>10 SEC ○<br>ROUND PLATE | START<br>MICROWAVE<br>500 W<br>X MIN XX SEC ○<br>CHANGED |
| CHEF | | FLASH ON AND OFF (→2) | FLASH ON AND OFF (→2) | | | | | | |
| START | | | FLASH ON AND OFF | OFF | | | | FLASH ON AND OFF | OFF |
| COLOR | GREEN | GREEN | GREEN | ORANGE | ORANGE | GREEN | GREEN | GREEN | ORANGE |
| SPEC. | | OUTPUT<br>500 W<br>200 W | | COUNT DOWN | REMAINING TIME<br>PERIOD CHANGEABLE<br>(→IMAGE A) | EXTENSION ACCEPTED<br>3 MIN | | | COUNT DOWN<br>REMAINING TIME<br>PERIOD CHANGEABLE |
| <> | | < | | | | | < | < | |

| NO. | a (IMAGE 2 →) | b | c |
|---|---|---|---|
| OPERATIONS | CHEF<br>HINTS FOR<br>SETTING TIME<br>DOUBLE HEATING<br>TIME PERIOD IF<br>FOOD AMOUNT<br>DOUBLES ↑ | ↑<br>(WRAP NECESSARY)<br>TO KEEP WATER<br>INSIDE FORM<br>EVAPORATION<br>STEW, SOUP<br>STEAMED FOOD ↑ | ↑<br>(WRAP NOT<br>NECESSARY)<br>TO SOMEWHAT<br>EVAPORATE WATER<br>INSIDE<br>STEAMED RICE, FRIES,<br>BROILED FOOD ↓ |
| CHEF | ON | ON | ON |
| START | | | |
| COLOR | GREEN | GREEN | GREEN |
| SPEC. | →FLASH ON AND OFF | →FLASH ON AND OFF | ←FLASH ON AND OFF<br>(→IMAGE 2) |
| <> | <> | <> | < |

FIG.7

| NO. | 1 | 2 | 3 | 4 | 5 | 6 | 7 | 8 | 9 |
|---|---|---|---|---|---|---|---|---|---|
| OPERATIONS | AUTOMATIC | CONFECTIONERIES | CREAM PUFF | CREAM PUFF | MATERIALS | 10 | . | . | . |
| | AUTOMATIC MENUS ● | CONFECTIONERIES COOKIE ○ | CREAM PUFF ● | CREAM PUFF PAGE 76 | CREAM PUFF PAGE 76 | 10 CREAM PUFFS (CUSTARD) 2 TABLESPOONFULS OF FLOUR 2 TABLESPOONFULS OF CORNSTARCH SUGAR 80g ⇧ ● | 10 CREAM PUFFS 2 CUPS OF MILK 3 MIDDLE SIZE EGG YOLKS 30g BUTTER 2 TEASPOONFULS OF BRANDY ⇧ ● | 10 CREAM PUFFS SMALL AMOUNT OF VANILLA ESSENCE (SHELL) 100mL WATER 50g BUTTER ⇧ ● | 10 CREAM PUFFS 50g FLOUR 2-3 MIDDLE SIZE EGGS ALUMINUM FOIL ⇧ ● |
| | CONFECTIONERIES BREAD ○ | CAKE ○ | ECLAIR ○ | MATERIALS ● | 10 (1 LAYER) ● | | | | |
| | DISHES (BROILED) ○ | CREAM PUFF ● | | MAKING CUSTARD ○ | 20 (2 LAYERS) ○ | | | | |
| | DISHES (STEAMED/STEWED) ○ | PUDDING/PIE /BAKED POTATO ○ | | MAKING SHELL ○ | | | | | |
| | | | | BAKING ○ | | | | | |
| CHEF START | | | | FLASH ON AND OFF (→a) | | | | | |
| COLOR SPEC. | GREEN | GREEN | GREEN | GREEN | GREEN | GREEN | GREEN | GREEN | GREEN |
| <> | | < | < | < | < | <> | <> | <> | <> (→ IMAGE 4) |

FIG.8A

| NO. | 10 | 11 | 12 | 13 | 14 | 15 | 16 |
|---|---|---|---|---|---|---|---|
| OPERATIONS | CREAM PUFF PAGE 76<br>MATERIALS O<br>MAKING CUSTARD ●<br>MAKING SHELL O<br>BAKING | MAKING CUSTARD<br>CREAM PUFF PAGE 76<br>10 (1 LAYER) ●<br>20 (2 LAYERS) O | 10<br>HEATING FLOUR<br>2 TABLESPOONFULS OF FLOUR<br>2 TABLESPOONFULS OF CORNSTARCH<br>(B) ● | HEATING FLOUR<br>MICROWAVE<br>ROUND PLATE WITHOUT WRAP<br>PRESS "START"<br>(E) | | START<br>HEATING OF FLOUR<br>MICROWAVE 500 W<br>(HEATING FLOUR) | HEATING FLOUR<br>MICROWAVE 500 W<br>XX SEC<br>(HEATING FLOUR) |
| CHEF | FLASH ON AND OFF (→a) | | FLASH ON AND OFF (→b) | FLASH ON AND OFF | | OFF | |
| START COLOR | GREEN | GREEN | GREEN | GREEN | | ORANGE | ORANGE |
| SPEC. | | | START KEY OPERABLE | | | | COUNTDOWN REMAINING TIME PERIOD UNCHANGEABLE |
| <> | < | < | · FLASH ON AND OFF <> | (→ IMAGE 17) <> | | | |

FIG.8B

| NO. | 17 | 18 | 19 | 20 | 21 | 22 | 23 | 24 | 25 | 26 |
|---|---|---|---|---|---|---|---|---|---|---|
| OPERATIONS | (TEMPORARILY STOPPED)<br>SUGAR MIXED<br>SUGAR ●<br>2 TABLESPOONFULS ○<br>OF MILK ○<br>(C) ⇧ | ·<br>EGG YOLKS MIXED INTO<br>3 MIDDLE SIZE<br>EGG YOLKS<br>2 CUPS OF<br>MILK<br>(C) ⇧ | ·<br>HEATING OF CUSTARD<br>MICROWAVE<br>ROUND PLATE<br>WITHOUT WRAP<br>PRESS "START"<br>(E) | | START<br>HEATING CUSTARD<br>MIX TWICE<br>IN-BETWEEN<br>TIMING IS<br>INFORMED BY<br>SOUNDS | (AFTER MEASURING WEIGHT)<br>HEATING CUSTARD<br>MICROWAVE 500 W<br>X MIN XX SEC<br>(HEATING FLOUR) ⇧ | (TEMPORARILY STOPPED)<br>HEATING CUSTARD<br>MIX WELL<br>(F) ⇧ | HEATING CUSTARD<br>MICROWAVE<br>ROUND PLATE<br>WITHOUT WRAP<br>PRESS "START"<br>(E) ⇧ | | START<br>HEATING CUSTARD<br>MICROWAVE<br>(X MIN XX SEC)<br>(HEATING FLOUR) |
| CHEF | FLASH ON AND OFF (→c) | | FLASH ON AND OFF (→d) | | FLASH ON AND OFF (→e) | | | | | |
| START | | | FLASH ON AND OFF | | OFF | | | FLASH ON AND OFF | | OFF |
| COLOR | GREEN | GREEN | GREEN | | ORANGE | ORANGE | GREEN | GREEN | | ORANGE |
| SPEC. | START KEY<br>OPERABLE | START KEY<br>OPERABLE | | | | COUNTDOWN<br>REMAINING TIME<br>PERIOD<br>UNCHANGEABLE | START KEY<br>OPERABLE | | | |
| <> | · FLASH ON AND OFF<br>> | · FLASH ON AND OFF<br><> | · FLASH ON AND OFF<br><> | | | | > | (→ IMAGE 31)<br><> | | |

FIG.8C

| NO. | 27 | 28 | 29 | 30 | 31 | 32 |
|---|---|---|---|---|---|---|
| OPERATIONS | (TEMPORARILY STOPPED) HEATING CUSTARD MIX WELL (F) | | HEATING CUSTARD MICROWAVE ROUND PLATE WITHOUT WRAP PRESS "START" (E) | START HEATING CUSTARD MICROWAVE 500 W X MIN XX SEC (HEATING FLOUR) | FINISHED (CHECKING OF FINISHED STATE) EXTENSION O | FINISHING CUSTARD 30g BUTTER WHEN COOLED, ADD 2 TEASPOONFULS OF BRANDY + SMALL AMOUNT OF VANILLA ESSENCE O |
| CHEF | | | FLASH ON AND OFF | OFF | FLASH ON AND OFF (i) | FLASH ON AND OFF (g) |
| START COLOR | GREEN | | GREEN | ORANGE | GREEN | GREEN |
| SPEC. | START KEY OPERABLE | | | COUNTDOWN REMAINING TIME PERIOD UNCHANGEABLE | EXTENSION ACCEPTED | |
| <> | > | | < | | <> | · FLASH ON AND OFF < (→ IMAGE 33) |

FIG.9A

| NO. | 33 | 34 | 35 | 36 | 37 | 38 | 39 | |
|---|---|---|---|---|---|---|---|---|
| OPERATIONS | START<br>CREAM PUFF PAGE 76<br>MATERIALS ○<br>MAKING CUSTARD ○<br>MAKING SHELL ●<br>BAKING ○ | MAKING SHELL<br>CREAM PUFF PAGE 76<br>10 (1 LAYER) ●<br>20 (2 LAYERS) ○ | 10<br>HEATING WATER & BUTTER<br>100mL WATER<br>50g BUTTER<br>1 TEASPOONFUL OF FLOUR<br>(C)<br>⇨ ● | HEATING WATER & BUTTER<br>MICROWAVE<br>ROUND PLATE WITHOUT WRAP<br>PRESS "START"<br>(E) | | START<br>HEATING WATER & BUTTER<br>MICROWAVE 500 W | HEATING WATER & BUTTER<br>MICROWAVE 500 W<br>X MIN XX SEC | |
| CHEF | FLASH ON AND OFF (→a) | | FLASH ON AND OFF (→i) | | | | | |
| START | | | | FLASH ON AND OFF | | OFF | | |
| COLOR | GREEN | GREEN | GREEN | GREEN | | ORANGE | ORANGE | |
| SPEC. | <> | < | START KEY OPERABLE<br>· FLASH ON AND OFF<br><> | (→ IMAGE 40)<br><> | | | COUNTDOWN REMAINING TIME PERIOD UNCHANGEABLE | |

FIG.9B

| NO. | 40 | 41 | 42 | 43 | 44 | 45 | 46 | 47 | 48 | 49 |
|---|---|---|---|---|---|---|---|---|---|---|
| OPERATIONS | (TEMPORARILY STOPPED)<br>FINISHED<br>CONTINUE HEATING IF NOT BOILED<br>EXTENSION ⇨ | ·<br>FLOUR KNEADED<br>50g FLOUR<br>(B) ⇨ | ·<br>HEATING DOUGH<br>MICROWAVE<br>ROUND PLATE WITHOUT WRAP<br>PRESS "START"<br>(E) | | START<br>HEATING DOUGH<br>MICROWAVE 500 W | (AFTER MEASURING WEIGHT)<br>HEATING DOUGH<br>MICROWAVE 500 W<br>XX SEC<br>(THE SAME AS THE LEFT) | FINISHED<br>(CHECKING OF FINISHED STATE)<br>EXTENSION ⇨ ○ ● | ·<br>MIXING EGGS<br>2-3 MIDDLE SIZE BEATEN EGGS<br>(E) ⇨ ● | ·<br>SQUEEZE OUT DOUGH, APPLY BUTTER ON ALUMINUM FOIL ON SQUARE PLATE THINLY<br>(70g) ⇨ ● | ·<br>SQUEEZE OUT DOUGH<br>SQUEEZE OUT DOUGH<br>(80) ⇦ ● |
| CHEF | | FLASH ON AND OFF (→i) | | | | | FLASH ON AND OFF (→k) | FLASH ON AND OFF (→m) | | FLASH ON AND OFF (→o) |
| START | | | FLASH ON AND OFF | | OFF | | | | | |
| COLOR | GREEN | GREEN | GREEN | | ORANGE | ORANGE | GREEN | GREEN | GREEN | GREEN |
| SPEC. | · FLASH ON AND OFF<br><> | <> | (→ IMAGE 46)<br><> | | | | EXTENSION ACCEPTED 3 MIN<br>· FLASH ON AND OFF<br><> | · FLASH ON AND OFF<br><> | · FLASH ON AND OFF<br><> | · FLASH ON AND OFF<br>< (→ IMAGE 50) |

FIG.9C

| NO. | 50 | 51 | 52 | 53 | 54 | 55 | 56 | 57 |
|---|---|---|---|---|---|---|---|---|
| OPERATIONS | (TEMPORARILY STOPPED)<br>CREAM PUFF<br>PAGE 76<br>MATERIALS O<br>MAKING CUSTARD O<br>MAKING SHELL O<br>BAKING ● | BAKING<br>BAKING<br>PAGE 76<br>10 (1 LAYER)<br>20 (2 LAYERS) ●<br>O | 10<br>BAKING<br>OVEN<br>SQUARE PLATE<br>PRESS "START"<br>(E) | | START<br>BAKING<br>FINISHED<br>THICK<br>STANDARD<br>THIN | (AFTER MEASURING WEIGHT)<br>BAKING<br>OVEN 190℃<br>CHANGED<br>25 MIN<br>CHANGED<br>XX MIN XX SEC<br>HEATING<br>BAKING | FINISHED<br>(FINISHED<br>CHEF)<br>EXTENSION O<br>⇨ ● | TAKING OUT<br>QUICKLY<br>REMOVE FROM<br>ALUMINUM FOIL<br>WHILE HOT<br>CHECK O<br>END ● |
| CHEF | FLASH ON AND OFF (→a) | | FLASH ON AND OFF (→g) | | | | | FLASH ON AND OFF (?) |
| START | | | FLASH ON AND OFF | | OFF | | | |
| COLOR | GREEN | GREEN | GREEN | | ORANGE | ORANGE | GREEN | GREEN |
| SPEC. <> | < | < | (→ IMAGE 56)<br><> | | | COUNTDOWN<br>REMAINING TIME<br>PERIOD<br>CHANGEABLE<br>TEMPERATURE<br>CHANGEABLE | EXTENSION<br>ACCEPTED 3 MIN<br>· FLASH ON AND OFF | EXTENSION<br>ACCEPTED 3 MIN |

FIG.10A

| NO. | a (IMAGE 4→) | b (IMAGE12→) | c (IMAGE 17→) | d (IMAGE 18→) | e | f (IMAGE 31→) | g (IMAGE 32→) | h | i (IMAGE 35→) | j (IMAGE 41→) |
|---|---|---|---|---|---|---|---|---|---|---|
| OPERATIONS | CHEF<br>START MAKING CUSTARD, BECAUSE IT IS TO BE COOLED | CHEF<br>HEAT FLOUR TO REMOVE ITS SMELL<br>(16) | CHEF<br>KNEAD WITH SMALL AMOUNT OF MILK TO PROCEED NEXT OPERATION SMOOTHLY | CHEF<br>EVAPORATE SOME WATER, HEAT WITHOUT WRAP TO MAKE IT THICK | | CHEF<br>UP TO LEVEL TRACES OF WIRES OF WHISK REMAIN BECOME SOLID WHEN COOLS | CHEF<br>DO NOT ADD BRANDY/VANILLA ESSENCE WHILE HOT UNLESS FLAVOR DISAPPEARS | >CLOSELY PLACE WRAP ON SURFACE TO KEEP OUT AIR, AND FILM DOES NOT FROM | CHEF<br>ADD SMALL AMOUNT OF FLOUR TO AVOID BOILING BY HEATING OF WATER AND BUTTER | CHEF<br>KNEAD WELL UNTIL DOUGH SMOOTHLY COMES OFF FROM BOWL |
| CHEF | ON | ON | ON | ON | | ON | ON | ON | ON | ON |
| START | | | | | | | | | | |
| COLOR | GREEN | GREEN | GREEN | GREEN | | GREEN | GREEN | GREEN | GREEN | GREEN |
| SPEC. <> | · FLASH ON AND OFF<br>< | · FLASH ON AND OFF<br>< | · FLASH ON AND OFF<br>< | · FLASH ON AND OFF<br>< | | · FLASH ON AND OFF<br>< | · FLASH ON AND OFF<br><> | · FLASH ON AND OFF<br>< (→ IMAGE 32) | · FLASH ON AND OFF<br>< | · FLASH ON AND OFF<br>< |

FIG.10B

| NO. | k (IMAGE 46→) | l | m (IMAGE 47→) | n | o (IMAGE 51→) | p (IMAGE 55→) | q | r | s (IMAGE 59→) | t (IMAGE 60→) |
|---|---|---|---|---|---|---|---|---|---|---|
| OPERATIONS | CHEF WATCH IF BUTTER SLIGHTLY OOZE OUT FROM DOUGH | IF NOT HEATED ENOUGH CONTINUE HEATING | CHEF RHYTHM FOR MIXING (Q) CHECKING HARDNESS | CHECKING HARDNESS OF DOUGH (R) TO IMAGE FOR RHYTHM | CHEF HOW TO ARRANGE (79) | CHEF SPRAY MIST ON DOUGH BEFORE FINISH BAKING (83) | MIST KEEP SURFACE FROM BEING DRIED AND SHELL BE RAISED FINE | DO NOT OPEN DOOR PANEL DURING BAKING UNLESS SHELLS SHRINK | CHEF IF COLOR OF SURFACE IS LIGHTER THAN DESIRED, CONTINUE HEATING | CHEF BOTTOM COULD STICK TO PLATE IF TAKEN OUT AFTER COOLED |
| CHEF | ON | ON | ON | ON | ON | ON | ON | ON | ON | ON |
| START COLOR | GREEN | GREEN | GREEN | GREEN | GREEN | GREEN | GREEN | GREEN | GREEN | GREEN |
| SPEC. | · FLASH ON AND OFF | · FLASH ON AND OFF (→ IMAGE 46) | · FLASH ON AND OFF | · FLASH ON AND OFF (→ IMAGE 47) | · FLASH ON AND OFF | · FLASH ON AND OFF | · FLASH ON AND OFF | · FLASH ON AND OFF (→ IMAGE 52) | · FLASH ON AND OFF | · FLASH ON AND OFF |

FIG. 10C

| NO. | A (IMAGE 31→) | B (IMAGE 56→) | C (IMAGE 57→) | D (IMAGE C→) | E (IMAGE C→) | F |
|---|---|---|---|---|---|---|
| OPERATIONS | EXTENSION<br>EXTENSION<br>MICROWAVE 500 W<br>0 SEC<br>1 MIN<br>10 SEC ● | EXTENSION<br>EXTENSION<br>190°C<br>▲ O<br>▼ O<br>0 MIN 10 MIN ●<br>1 MIN O | CHECK<br>CHECK<br>FLATTENED ●<br>NOT RAISED ENOUGH O<br>(14)<br>⇦ ● | FLATTENED<br>TOO MUCH BEATEN EGGS BE CAREFUL ABOUT HARDNESS OF DOUGH<br>(16)<br>⇦ ● | NOT RAISED ENOUGH<br>BEATEN EGGS NOT ENOUGH BE CAREFUL ABOUT HARDNESS OF DOUGH<br>(16)<br>⇨ ● | ·<br>NOT KNEADED ENOUGH AFTER FLOUR IS MIXED<br>(16)<br>⇦ ● |
| CHEF | | | | | | |
| START | | | | | | |
| COLOR | GREEN | GREEN | GREEN | GREEN | GREEN | GREEN |
| SPEC. | <> < | < | · FLASH ON AND OFF<br>< | · FLASH ON AND OFF<br>< | · FLASH ON AND OFF<br><> | · FLASH ON AND OFF<br>< |

MIXING 1

MIXING 2

MIXING 3

MIXING 4

MIXING 5

HARDNESS OF DOUGH 1

HARDNESS OF DOUGH 2

HARDNESS OF DOUGH 3

HARDNESS OF DOUGH 4

HARDNESS OF DOUGH 5

HARDNESS OF DOUGH 6

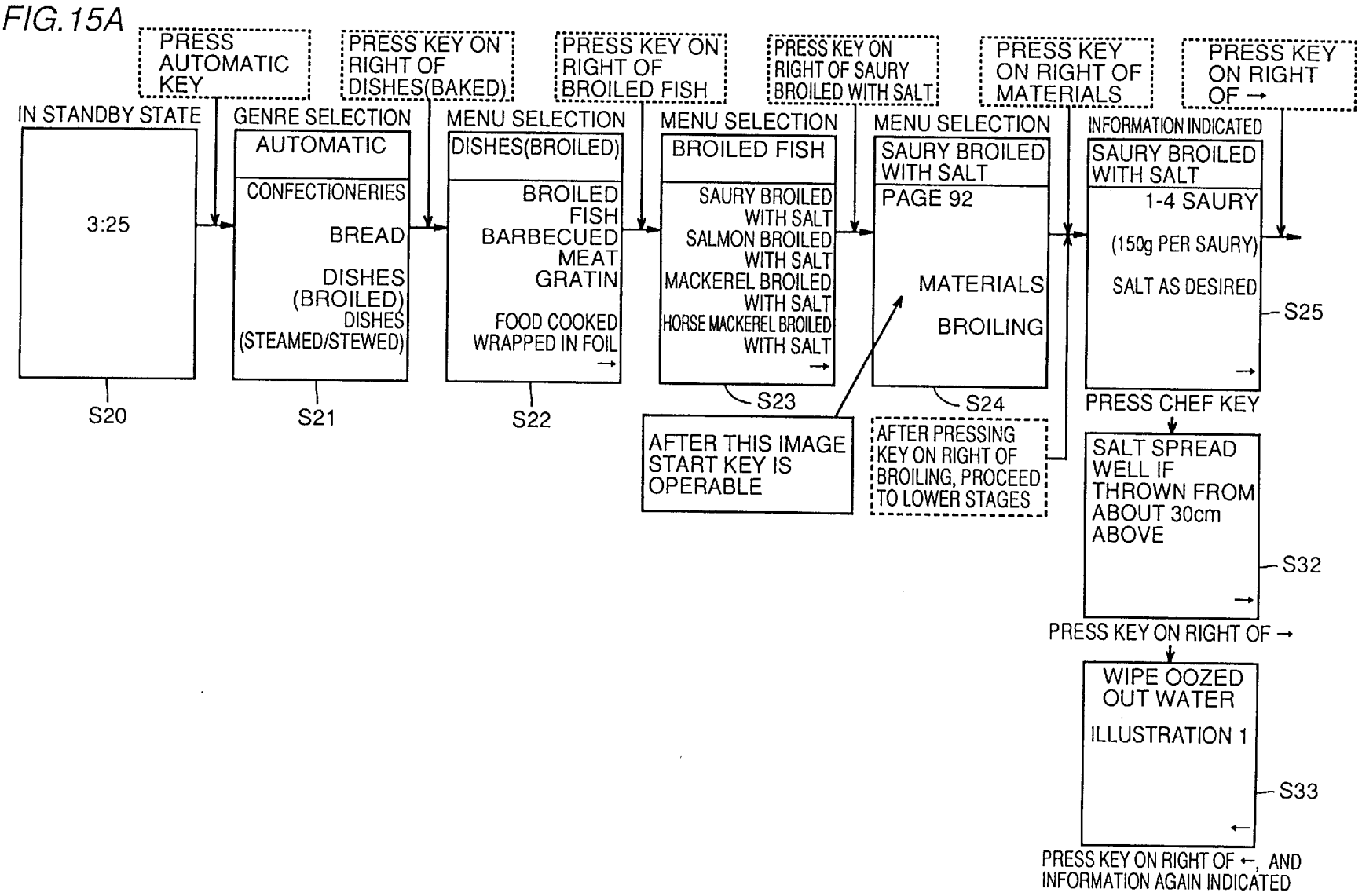
FIG. 15A
IN STANDBY STATE
3:25
S20
PRESS AUTOMATIC KEY
GENRE SELECTION
AUTOMATIC
CONFECTIONERIES
BREAD
DISHES (BROILED)
DISHES (STEAMED/STEWED)
S21
PRESS KEY ON RIGHT OF DISHES(BAKED)
MENU SELECTION
DISHES(BROILED)
BROILED FISH
BARBECUED MEAT
GRATIN
FOOD COOKED WRAPPED IN FOIL
S22
PRESS KEY ON RIGHT OF BROILED FISH
MENU SELECTION
BROILED FISH
SAURY BROILED WITH SALT
SALMON BROILED WITH SALT
MACKEREL BROILED WITH SALT
HORSE MACKEREL BROILED WITH SALT
S23
AFTER THIS IMAGE START KEY IS OPERABLE
PRESS KEY ON RIGHT OF SAURY BROILED WITH SALT
MENU SELECTION
SAURY BROILED WITH SALT
PAGE 92
MATERIALS
BROILING
S24
AFTER PRESSING KEY ON RIGHT OF BROILING, PROCEED TO LOWER STAGES
PRESS KEY ON RIGHT OF MATERIALS
INFORMATION INDICATED
SAURY BROILED WITH SALT
1-4 SAURY
(150g PER SAURY)
SALT AS DESIRED
S25
PRESS KEY ON RIGHT OF →
PRESS CHEF KEY
SALT SPREAD WELL IF THROWN FROM ABOUT 30cm ABOVE
S32
PRESS KEY ON RIGHT OF →
WIPE OOZED OUT WATER
ILLUSTRATION 1
S33
PRESS KEY ON RIGHT OF ←, AND INFORMATION AGAIN INDICATED

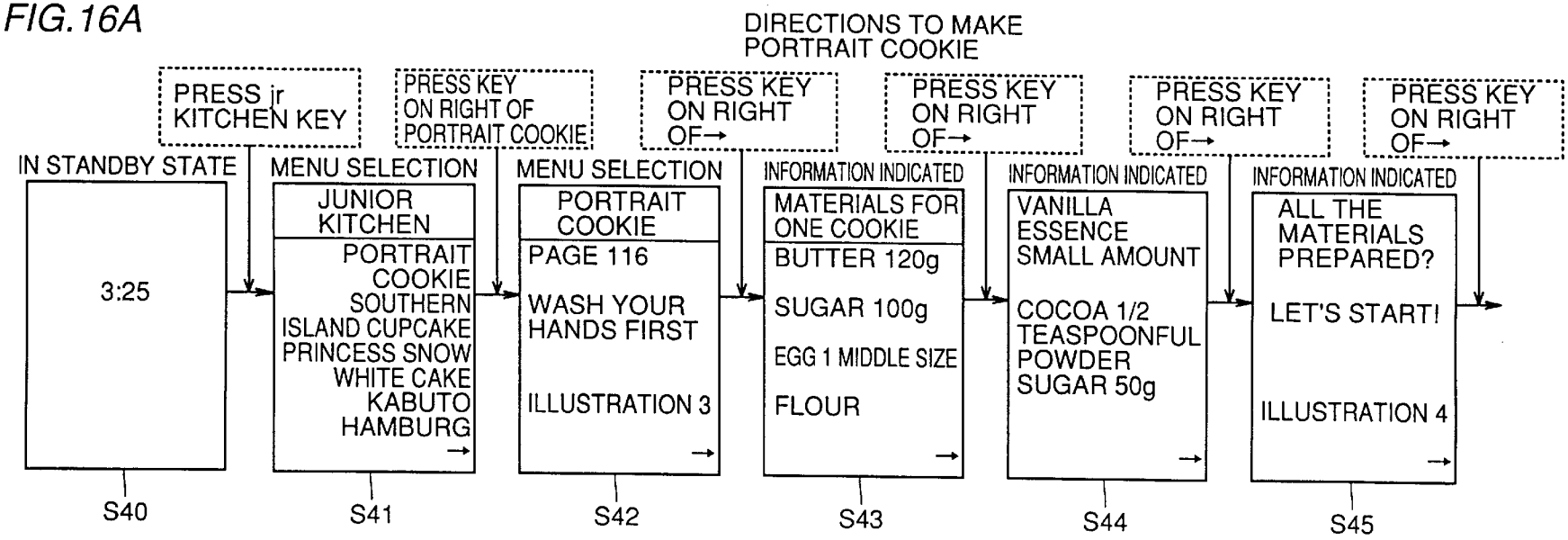
FIG.16A
DIRECTIONS TO MAKE PORTRAIT COOKIE
IN STANDBY STATE
3:25
S40
PRESS jr KITCHEN KEY
MENU SELECTION
JUNIOR KITCHEN
PORTRAIT COOKIE
SOUTHERN ISLAND CUPCAKE
PRINCESS SNOW WHITE CAKE
KABUTO HAMBURG
S41
PRESS KEY ON RIGHT OF PORTRAIT COOKIE
MENU SELECTION
PORTRAIT COOKIE
PAGE 116
WASH YOUR HANDS FIRST
ILLUSTRATION 3
S42
PRESS KEY ON RIGHT OF
INFORMATION INDICATED
MATERIALS FOR ONE COOKIE
BUTTER 120g
SUGAR 100g
EGG 1 MIDDLE SIZE
FLOUR
S43
PRESS KEY ON RIGHT OF
INFORMATION INDICATED
VANILLA ESSENCE SMALL AMOUNT
COCOA 1/2 TEASPOONFUL POWDER
SUGAR 50g
S44
PRESS KEY ON RIGHT OF
INFORMATION INDICATED
ALL THE MATERIALS PREPARED?
LET'S START!
ILLUSTRATION 4
S45
PRESS KEY ON RIGHT OF

MAKING DOUGH OF CREAMPUFF

DISPLAY PATTERN OF IMAGE NO.36

DISPLAY PATTERN OF IMAGE NO.42

ILLUST.1

ILLUST.2

ILLUST.3

ILLUST.4

ILLUST.5

ILLUST.6

ILLUST.7

ILLUST.8

ILLUST.9

ILLUST.10

ILLUST.11

ILLUST.12

ILLUST.13

ILLUST.14

ILLUST.15

ILLUST.16

ILLUST.17

ILLUST.18

ILLUST.19

ILLUST.20

ILLUST.21

ILLUST.22

ILLUST.23

ILLUST.24

ILLUST.25

ILLUST.26

FIG.54

| TONES | NOTATIONS | WAVEFORMS/FREQ/TIME | USE |
|---|---|---|---|
| 1.OPERATION | | 783(Hz) 0.12 0.24 0.36 | WHEN OPERATING SELECT BUTTON FOR AUTOMATIC, USUAL, MANUAL, JUNIOR, IMAGE FORWARDING / RETURNING BUTTON |
| 2.START | | 659 783 1046 1318(Hz) 0.06 0.06 0.06 0.12 0.24 0.36 | WHEN OPERATING START BUTTON |
| 3.CANCEL | | 1046 1046(Hz) 0.12 0.12 0.18 0.36 | WHEN OPERATING CANCEL BUTTON |
| 4.HINT | | 880 932 987 1046 1174 1046(Hz) 0.24 0.24 0.3 0.12 0.36 | WHEN OPERATING HINT BUTTON |
| 5.END OF HEATING | | 1318 880 1174 1396 1046 783 1046 1046 OFF 0.36 0.18 0.18 0.18 0.18 0.36 0.36 0.36 0.3 0.36 | AT THE COMPLETION OF HEATING |

COOKING APPARATUS SEQUENTIALLY DISPLAYING COOKING METHODS ON ITS DISPLAY AND COOKING METHODS USING SUCH COOKING APPARATUS

BACKGROUND OF THE INVENTION

1. Field of the Invention

The present invention relates to cooking apparatuses and, more particularly, to a cooking apparatus having a display on its operation panel.

2. Description of the Background Art

Microwave ovens known as one form of cooking apparatus have been devised in various manners for the convenience of users as will-be described. For instance, in a multi-function microwave oven as shown in FIG. 1, in the operation panel, there are provided start key 101 to instruct automatic heating or keys 102 to 105 to select "OVEN", "MICROWAVE", "GRILL" and "STEW" to instruct manual heating. The display includes names of dishes frequently cooked using the microwave oven or names of dishes characteristic of the microwave oven. For other dishes, a corresponding page of "Cooking Book" such as P-11 is displayed.

The microwave oven will probably have an increased number of functions in the future, and improvement of the operability is desired. The conventional microwave oven as described above has numerous keys and indications related to cooking on its operation panel which are complicated and cumbersome to use. Directions for dishes supposed to be frequently cooked by the microwave oven or dishes most suitably cooked by the microwave oven are displayed. As to other kinds of dishes, however, which page in the attached cooking book to find is simply displayed, the cooking directions are not available by the microwave oven itself, and the user may feel tiresome to use the device.

SUMMARY OF THE INVENTION

It is an object of the invention to provide a cooking apparatus which saves time to take out and look at an attached cooking book or instruction manual and permits various dishes to be easily cooked.

Another object of the invention is to provide a cooking method which saves trouble to take out and look at an attached cooking book or instruction manual and permits various dishes to be easily cooked.

According to one aspect of the invention, the cooking apparatus includes an external memory for storing cooking methods of various dishes, a genre key to specify one group out of a plurality of large groups of cooking methods produced by classifying the cooking methods stored in the external memory based on the kind of cooking, a display to display items corresponding to the group of cooking methods specified by the genre key, a select key to select one out of the displayed items corresponding to the group of cooking methods, and a microcomputer to control a cooking operation based on the item selected by the select key.

The display displays the items corresponding to the specified group of cooking methods from the plurality of large groups. Since the user can select among items corresponding to the displayed cooking method, he/she can readily cook various dishes.

According to another aspect of the invention, the cooking method using a cooking apparatus sequentially displaying cooking methods includes the steps of receiving an instruction to specify one out of a plurality of large groups produced by classifying cooking methods based on the kind of cooking, displaying items corresponding to the specified group of cooking methods, receiving an instruction to select one out of the items corresponding to the displayed group of cooking methods, and controlling a cooking operation based on the selected item.

The user specifies one group among the plurality of large groups produced by classifying cooking methods based on the kind of cooking, and selects one from the items corresponding to the displayed group of cooking methods for cooking operations. Therefore, the user can easily cook various dishes.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 is a view showing a content on the display of the cooking apparatus according to the invention in the manual cooking mode;

FIG. 7 is a view showing a content including a list of materials for a cream puff indicated on the display of the cooking apparatus according to the invention in the manual cooking mode;

FIGS. 8A to 8C are views showing the content of the procedure of preparing custard for the cream puff;

FIGS. 9A to 9C are views showing the content of the procedure of preparing dough for the shell of a cream puff and baking thereof;

FIGS. 10A to 10C are views showing how to operate the chef key and contents to check in making a cream puff;

FIGS. 15A and 15B show contents indicated on the display of the cooking apparatus according to the invention in an automatic cooking mode;

FIGS. 16A, 16B, 17A, 17B, 18A, 18B, 19A, and 19B show contents indicated on the display of the cooking apparatus according to the invention in a junior kitchen cooking mode;

FIG. 54 shows the relation between the kind of a sound generated when each key on the operation panel is operated, its notation, and the output waveform of the information sound generator;

DESCRIPTION OF THE PREFERRED EMBODIMENTS

Now, a cooking apparatus according to the invention will be described in conjunction with the accompanying drawings. Note however that a microwave oven will be described as one embodiment of the invention.

Figure 1:
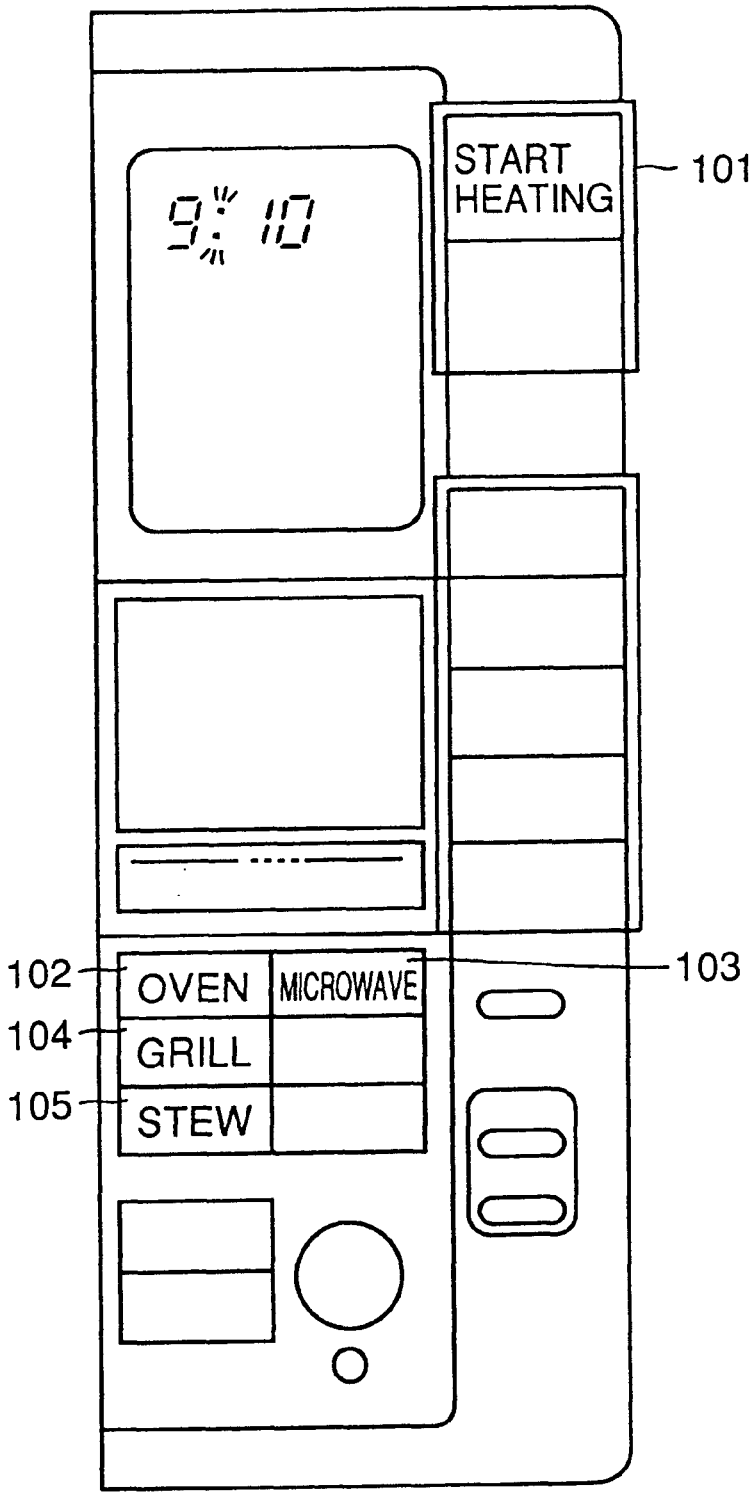
FIG. 1 PRIOR ART
FIG. 1 is a view showing an example of the operation panel of a conventional cooking apparatus.
Figure 2:
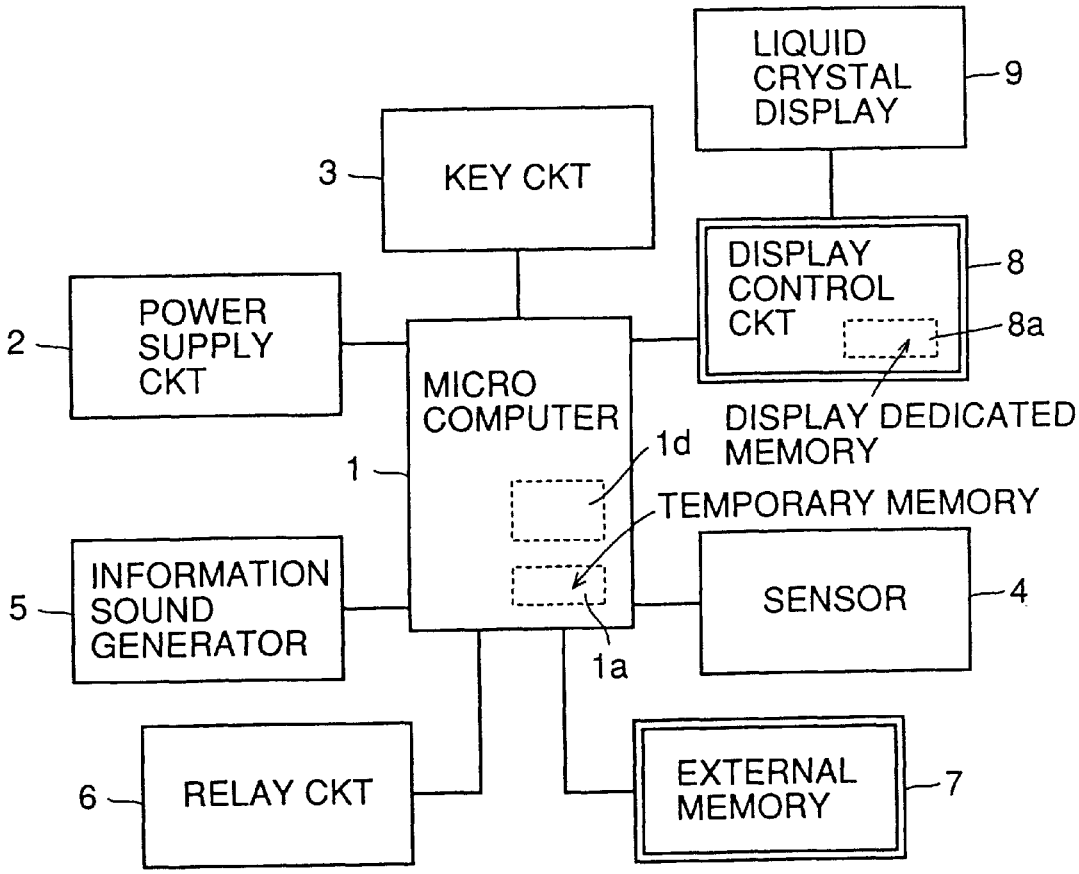
FIG. 2 is a block diagram showing the structure of a control circuit in a cooking apparatus according to the invention.
Figure 3:
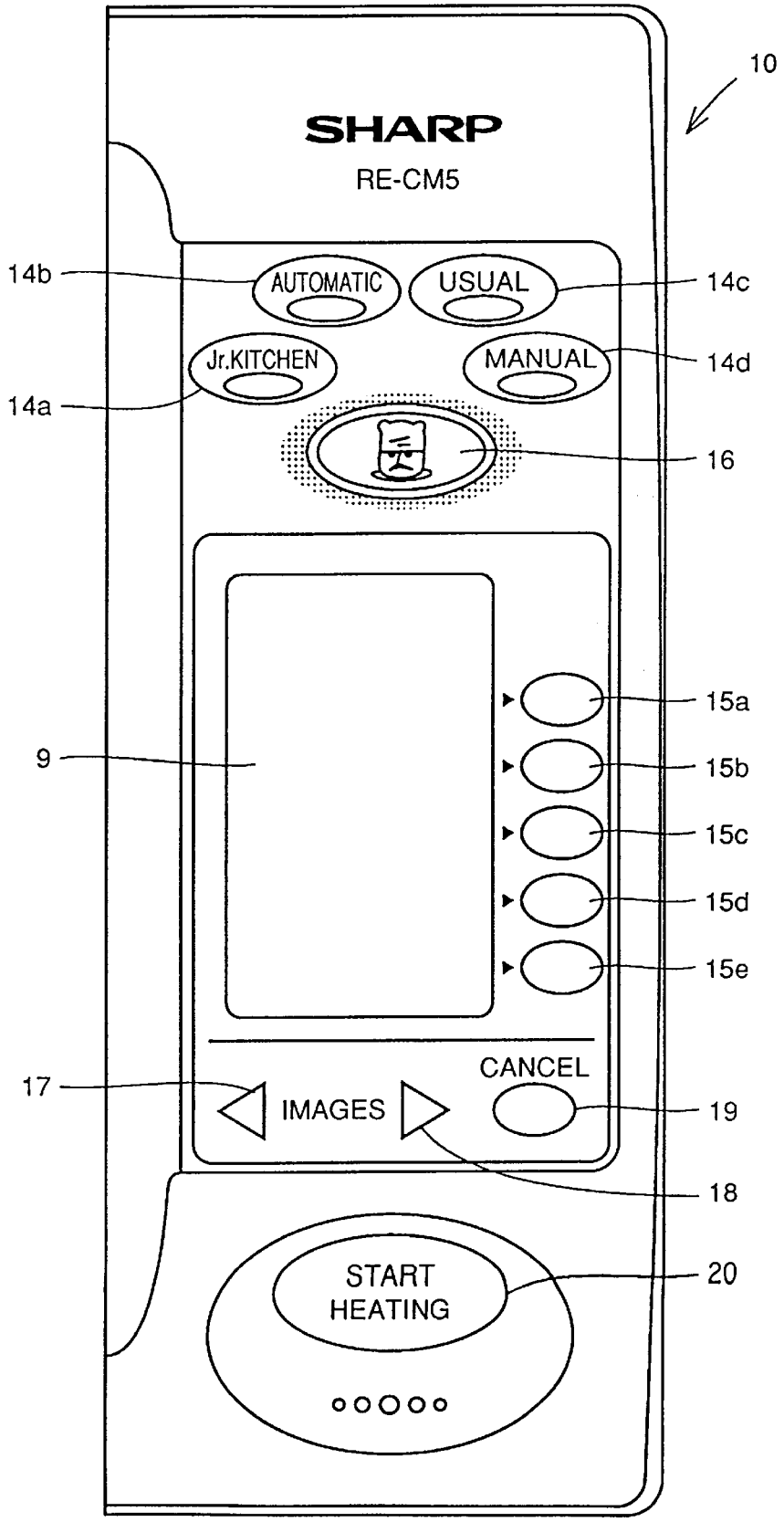
FIG. 3 is a view showing the operation panel of the cooking apparatus according to the invention.

Referring to FIG. 2, the microwave oven includes a microcomputer 1 having a temporary memory 1*a* for controlling various operations of the microwave oven, a power supply circuit 2, a key circuit 3 for outputting signals corresponding to the operation of various keys on an operation panel 10 shown in FIG. 3, a sensor 4 for sensing the temperature of food in the oven (not shown) or the like, an information sound generator 5 for outputting various information sounds depending upon the operation state of the microwave oven, a relay circuit 6 functioning to switch the operation state of the driving circuit of the microwave oven, a large capacity external memory 7, and a display control circuit 8 for controlling the driving of a liquid crystal display 9 provided in operation panel 10.

Liquid crystal display 9 employs STN liquid crystal of a full dot matrix having 119 dots in the longitudinal direction and 73 dots in the-transverse direction (though the number of dots is not limited to the above).

Since liquid crystal does not emit light by itself, liquid crystal display 9 has on the back surface of the liquid crystal panel a back light unit provided on printed circuit board 11 using a red LED (Light Emitting Diode) 12R and a green LED 12G as an optical source.

Using the LEDs in these two colors, light in three colors "RED", "GREEN" and "ORANGE" (red light and green light are simultaneously emitted) can be emitted depending upon the operation mode of the microwave oven.

By displaying various information in different colors, for example, the process of waiting, and standing by in green, heating in red, and cooking hints in orange, the user can determine the presently proceeding operation mode from a place somewhat away from the microwave oven. The colors may be changed by pressing a particular key if desired. The area of display or brightness of the liquid crystal panel may be changed by limiting the number of LEDs to emit light or changing the amount of emitted light. Red LEDs 12R and green LEDs 12G are paired, placed at equal distances longitudinally and in two rows on the printed circuit board 11, and entirely surrounded by a rectangular light shielding frame 13.

Microcomputer 1 includes temporary memory 1*a* as described above. According to the invention, numerous contents are displayed on liquid crystal display 9 including item selection, cooking, message, and illustrations, each display data is enormous, and therefore external memory 7 is provided outside microcomputer 1. According to the invention, external memory 7 stores display data, information sound data, cooking data and operation programs for the microcomputer.

However, some specifications do not need such a large amount of display data, operation programs and the like, and in such a case they may be stored within the inner memory 1*d* of microcomputer 1. At the time of actually reading out the display data, microcomputer 1 reads out display data for one image plane a number of times, and each time stores the read out data in temporary memory 1*a*.

Now, the display data stored in the temporary memory 1*a* of microcomputer 1 is transferred and temporarily stored in a display-dedicated memory 8*a* built in display control circuit 8. Display control circuit 8 sequentially transmits the display data stored in display-dedicated memory 8*a* as display data signals on a one-column-basis in the longitudinal direction. This operation is conducted 73 times while shifting transversely, display data signals in each column are transmitted at prescribed time intervals and the display for one picture plane completes. This is repeated for stable display.

Figure 4A:
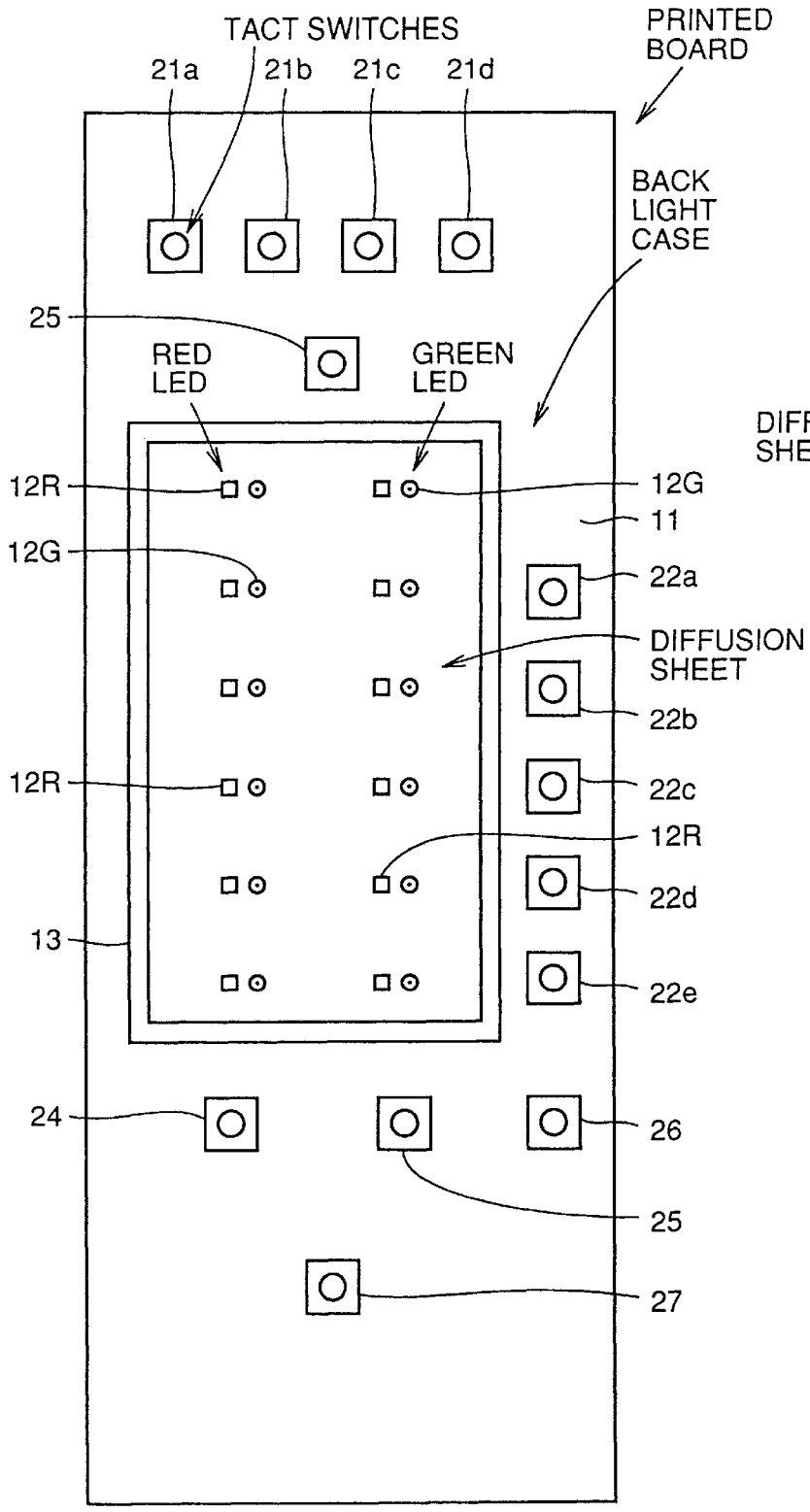
FIGS. 4A and 4B are views showing a printed circuit board provided opposite to the back surface of the operation panel.
Figure 4B:
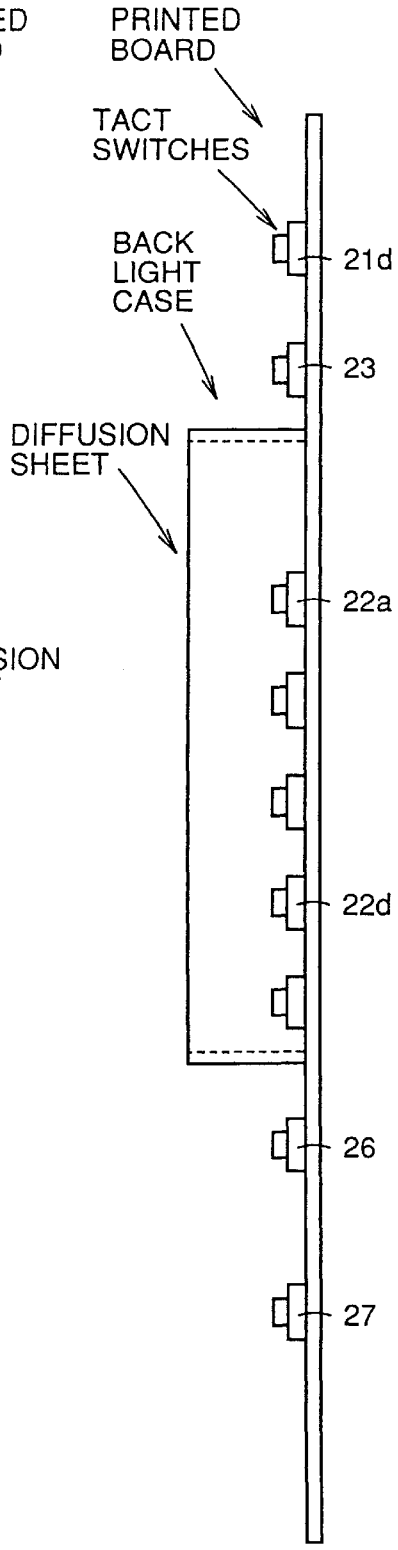

As shown in FIG. 3, on operation panel 10, there are provided genre keys 14*a* to 14*d* specifying one out of large groups of cooking methods of various dishes (Jr. KITCHEN, AUTOMATIC, USUAL, MANUAL), select keys 15*a* to 15*e* provided along a side edge of liquid crystal display 9 for selecting a cooking method corresponding to a content displayed on liquid crystal display 9, a chef key 16 for calling and displaying cooking hints, page advance keys 17, 18 for restoring/advancing the display image of liquid crystal display 9, a cancel key 19, and a start key 20. Meanwhile, as shown in FIG. 4, on printed circuit board 11, there are provided genre switches 21*a* to 21*d*, select switches 22*a* to 22*e*, a chef switch 23, page advance switches 24, 25, a cancel switch 26 and a start switch 27 corresponding to the above described keys.

(1) Manual Cooking Mode

In the control circuit of the microwave oven, a manual cooking mode will be described in conjunction with FIGS. 5 and 6.

Figure 5:
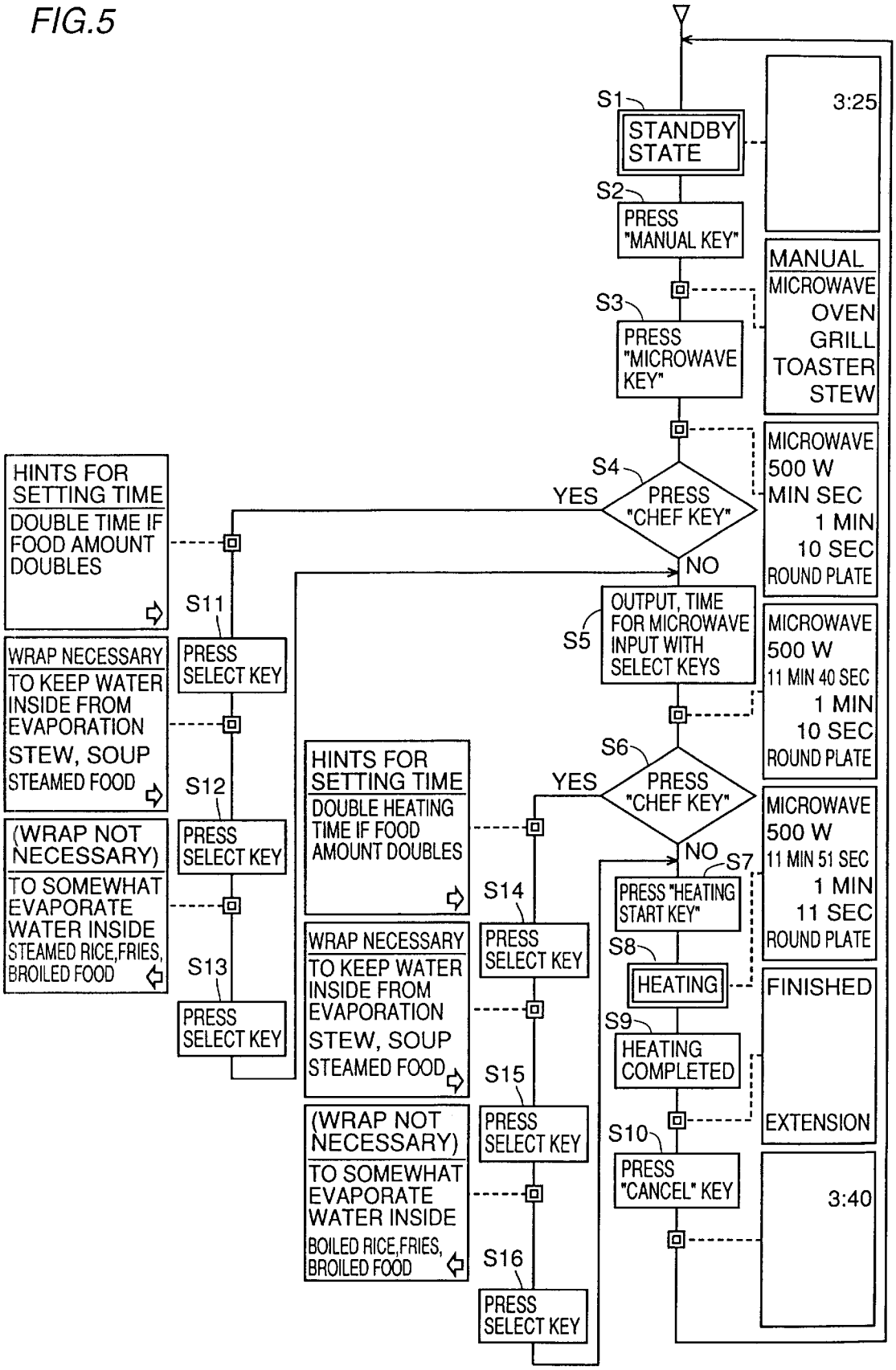
FIG. 5 is a flow chart for use in illustration of the operation of the cooking apparatus according to the invention in a manual cooking mode.

Referring to FIG. 5, in a standby state (step S1), the user press genre key 14*d* to select "MANUAL" (step S2), and then microcomputer 1 receives from key circuit 3 a signal indicating that genre key 14*d* has been pressed. Display data corresponding to the selection is read out from external memory 7, temporarily stored in the built-in temporary memory 1*a*, and also supplied to display control circuit 8. Display control circuit 8 temporarily stores the display data in the built-in display-dedicated memory 8*a*, drives liquid crystal display 9 based on the temporarily stored display data, and the image of image No. 1 shown in FIG. 6 is displayed.

More specifically, liquid crystal display 9 displays "MICROWAVE", "OVEN", "GRILL", "TOASTER", and "STEW" in green at positions corresponding to select keys 15*a* to 15*e*. When the user presses select key 15*a* on the right of "MICROWAVE" (step S3), "MICROWAVE" is reversely displayed with letters in void as long as select key 15*a* is pressed (not shown).

Then, when the user releases select key 15*a*, liquid crystal display 9 shows the image of image No. 2 shown in FIG. 6, and "l", "1 MIN", and "10 SEC" are displayed in green at positions corresponding to select keys 15*a*, 15*c* and 15*d*. In this state, "ROUND PLATE" indicating an accessory used for heating by microwaves is displayed as well. At the time, chef key 16 is flashing on and off.

In this display state, the user operates select keys 15*a*, 15*c* and 15*d* to set a microwave oven output and time for heating (step S5). Once the microwave output and time for heating are set (output: 500 w, time: 10 MIN 00 SEC in this example), liquid crystal display 9 changes to the image of image No. 3 shown in FIG. 6 under the control of microcomputer 1, "500 w", and "10 MIN 00 SEC" are displayed on liquid crystal display 9, and chef key 16 and start key 20 flash on and off.

In the state, when the user presses start key 20 (step S7), microcomputer 1 drives a magnetron which is not shown to start heating food inside the oven (step S8). Once heating is started, start key 20 is turned off, and the display color of the letters on liquid crystal display 9 change to orange. At the time, the remaining time of heating is displayed on liquid crystal display 9 (image Nos. 4 and 5 shown in FIG. 6).

When the heating time expires, and the cooking completes (step S9), image No. 6 "FINISHED" in FIG. 6 is displayed. If additional heating is desired, the user presses the select key to instruct extension, and the display switches to extension setting images of image Nos. 7 and 8 shown in FIG. 6. The user sets an extra time period and presses start key 20 flashing on and off to once again start heating (image No. 9 in FIG. 6).

Meanwhile, as chef key 16 flashing on and off as in image Nos. 2 and 3 in FIG. 6, when the user presses chef key 16 (step S4 or step S6), the display state of liquid crystal display 9 transits to image a in FIG. 6, and cooking hints in heating by microwaves are displayed. In this state, when a select key on the right of arrow "→" is pressed (steps S11 and S12 or steps S14 and S15), liquid crystal display 9 transits to images b and c in FIG. 6 and displays the continuation of cooking hints.

When the user presses a select key on the right of "←" in image c shown in FIG. 6 at the end of these cooking hints (steps S13 or S16), the operation transits to steps S5 or S7. By pressing cancel key 19 after step S9 in which the heating completes (step S10), the process returns to the standby state (step S1).

If the user is uncertain about something in cooking, for example if he/she is not sure about time to heat an amount for two persons while he/she knows how long to heat an amount for one person or if a plastic wrap is necessary for some item in microwave cooking, information is available by pressing chef key 16. Chef key 16 flashes on and off when it can provide valuable information to the user, and therefore necessary information is conveniently available at the moment, without looking into the cooking book or the like. If such information is not necessary, he/she can simply proceed to further steps.

(2) Automatic Cooking Mode

Now, how to make "CREAM PUFF" will be described by way of illustrating an automatic cooking mode. FIGS. 7 to 10C sequentially show contents displayed by liquid crystal display 9 according to operation steps included in making "CREAM PUFF". In these figures, FIG. 7 shows that the automatic cooking mode is started, "CREAM PUFF" is selected, and "MATERIALS" are displayed. FIGS. 8A to 8C show the content of the procedure of "MAKING CUSTARD", FIGS. 9A to 9C "MAKING SHELL" and "BAKING". FIGS. 10A to 10C shows a display content if "CHEF KEY" or "CHECK" is selected.

In the standby state in which only a clock is displayed on liquid crystal display 9, the user presses genre key 14*b* to select "AUTOMATIC", and microcomputer 1 then detects the pressing of genre key 14*b*. Microcomputer 1 reads out display data related to image No. 1 in FIG. 7 from external memory 7, and displays the content on liquid crystal display 9 through display control circuit 8. As shown in FIG. 7, image No. 1 displays "CONFECTIONERIES", "BREAD" and the like.

The user then presses select keys on the right of liquid crystal display 9 to first select "CONFECTIONERIES", then "CREAM PUFF" (image No. 2), and then "CREAM PUFF" (image No. 3), and sets the automatic cooking mode of "CREAM PUFF" (image No. 4). Then, by pressing select keys 15*a* to 15*e*, the cooking condition is adjusted among the contents of "MATERIALS", "MAKING CUSTARD", "MAKING SHELL" displayed on liquid crystal display in an interactive manner.

As can be seen from FIGS. 7 to 9C, for any of the contents displayed in image Nos. 9, 32 and 49, when the user presses a select key corresponding to "←" displayed on liquid crystal display 9 in each state, the liquid crystal display returns to the image of "CREAM PUFF" in image No. 4.

If the user presses the select key to select "BAKING" here, image No. 51 in FIG. 9C is displayed, then the material for how many cream puffs are placed in the oven (10, for example) is selected, and start key 20 is pressed to start "BAKING" (image No. 54). Since the user thus sets the number to bake, sensors such as height sensor and number sensor may be omitted. Note however that since a weight sensor (not shown) is attached, the heating operation may be modified based on the number of pieces actually placed if the user erroneously sets the number. When the heating completes, image No. 56 ("FINISHED") is displayed, the select key on the right of arrow "→" is pressed to display image No. 57, and a select key corresponding to "CHECK" is pressed to display image C in FIG. 10C.

If the user presses a select key corresponding to "FLATTENED" or "NOT RAISED ENOUGH" after observing the finished state, images D, E or F indicating the cause is displayed. The display advises the user so that he/she can cook successfully the next time, and the advice together with the failure is stored in external memory 7 or temporary memory 1*a* in microcomputer 1.

Figure 11:
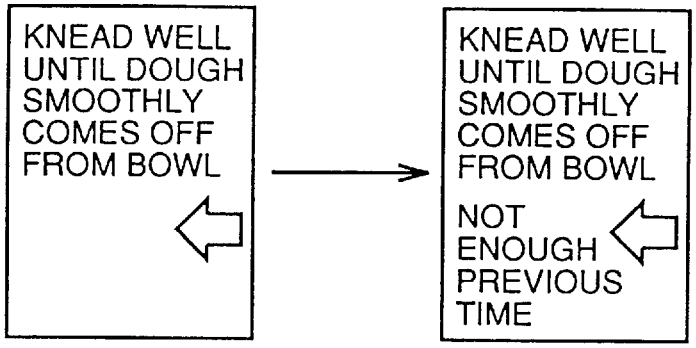
FIG. 11 shows an example of advise in cooking by the cooking apparatus according to the invention.

The stored failure or advice will be utilized as reference information next time the user makes a cream puff. The next time the user makes a cream puff, the advice based on the failure is timely given during performing a series of operations following image numbers from the standby state (see FIGS. 11 and 12).

Assume for example that image F "NOT KNEADED ENOUGH AFTER FLOUR IS MIXED" was displayed in checking the finished state in the previous time. In such a case, the content displayed by image j ("KNEAD WELL UNTIL DOUGH SMOOTHLY COMES OFF FROM BOWL") is added with information "NOT ENOUGH IN PREVIOUS TIME" to advice the user (FIG. 11), when the user presses the "CHEF KEY" looking at the image showing mixing of the dough after first heating for making the shells of cream puffs (image No. 41 in FIG. 9B).

Figure 12:
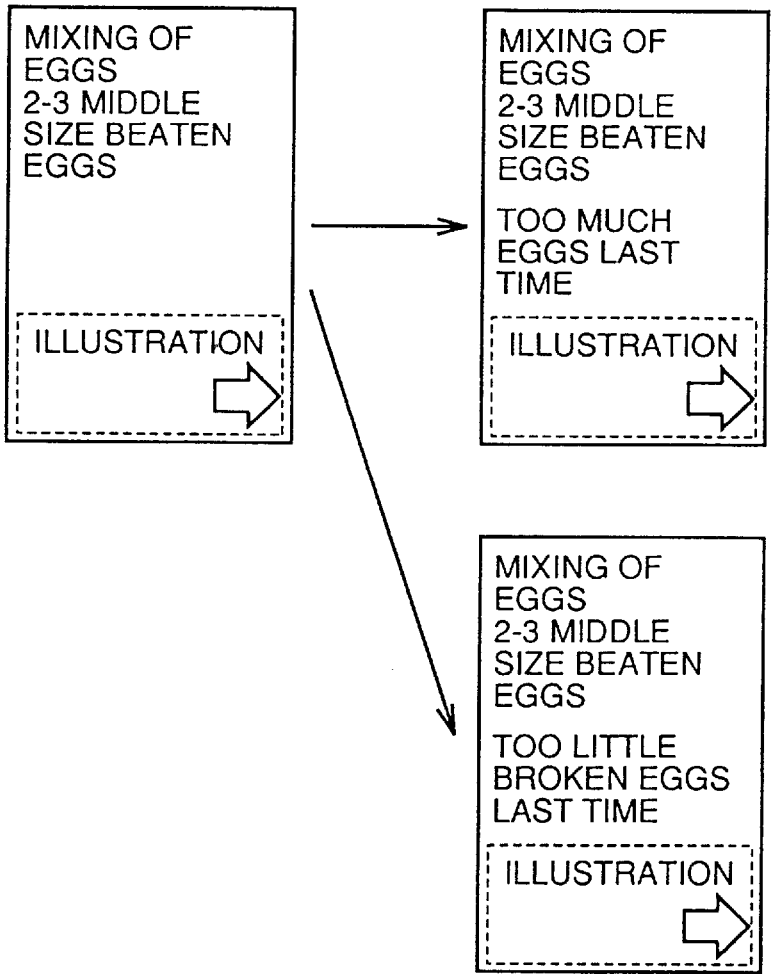
FIG. 12 shows another example of advice in cooking by the cooking apparatus according to the invention.
Figure 13A:
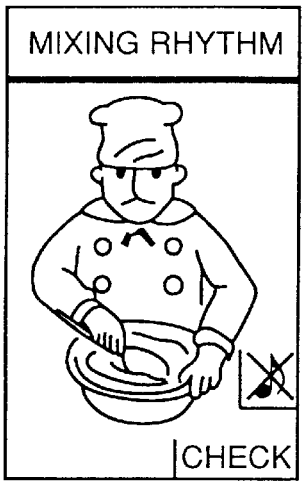
FIGS. 13A to 13E show an example of animated illustration on the display related to a cooking operation in the cooking apparatus according to the present invention.
Figure 13B:
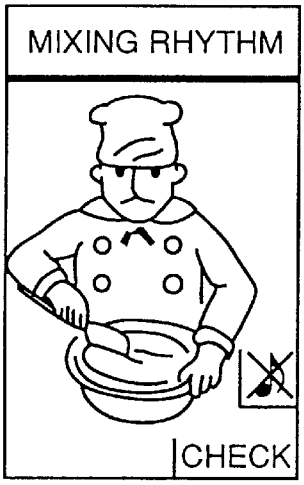
Figure 13C:
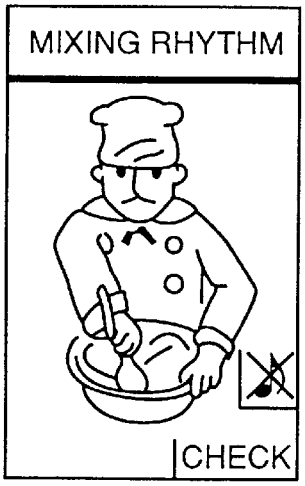
Figure 13D:
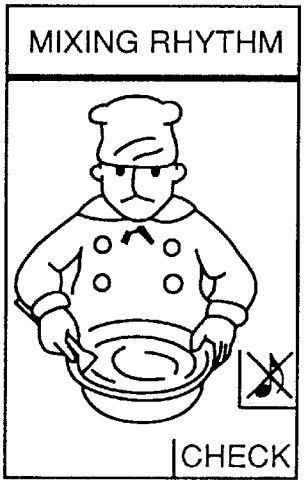
Figure 13E:
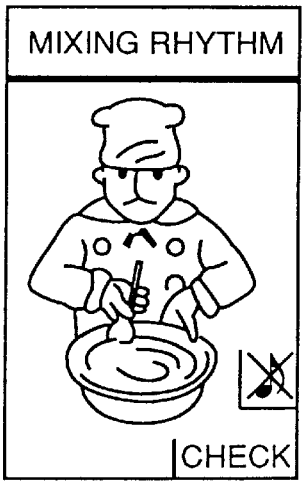
Figure 14A:
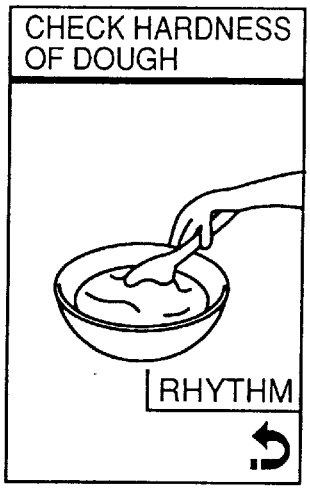
FIGS. 14A to 14F show another example of animated illustration on the display related to a cooking operation in the cooking apparatus according to the invention.
Figure 14B:
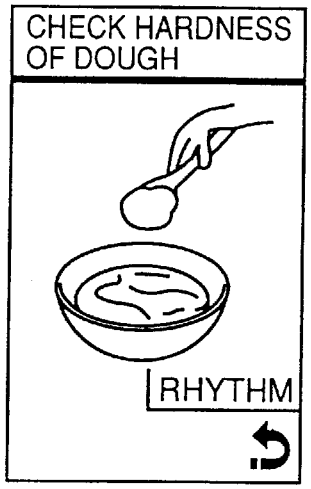
Figure 14C:
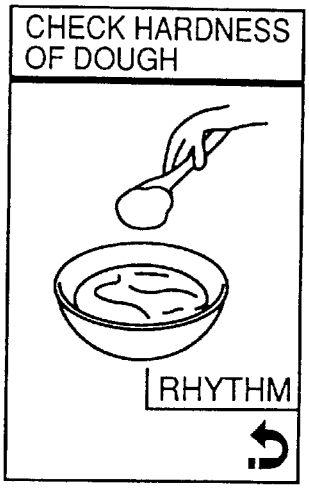
Figure 14D:
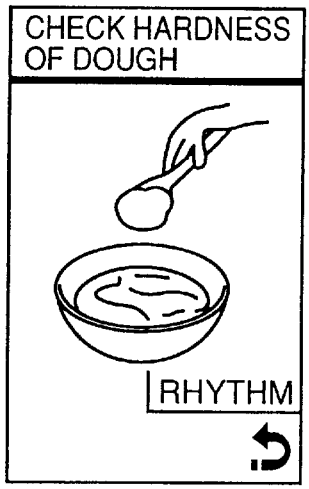
Figure 14E:
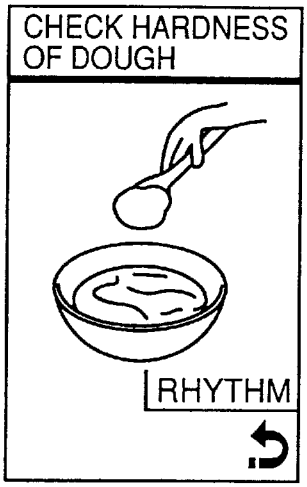
Figure 14F:
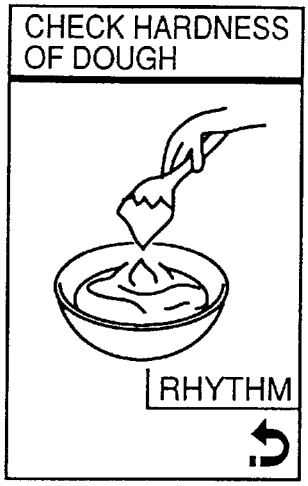

Similarly, if image D "TOO MUCH BEATEN EGGS, BE CAREFUL ABOUT HARDNESS OF DOUGH" or image E "BEATEN EGGS NOT ENOUGH, BE CAREFUL ABOUT HARDNESS OF DOUGH" was displayed in checking of the finished state in the previous time, "TOO MUCH BEATEN EGGS LAST TIME" or "BEATEN EGGS NOT ENOUGH LAST TIME" is additionally displayed in the egg mixing image after heating for making the shells of cream puffs (image No. 47) based on the advises in the previous time to advice the user (FIG. 12).

For each dish which can be checked for its finished state in automatic cooking, an advice is additionally displayed in an appropriate timing in the next time as is the above. Thus, the same failure will not be repeated, and the finished state should be better the next time and on. Note that if no item of failure is selected in checking of the finished state, such an advice will not be additionally displayed in the following time.

In this embodiment, the operation displayed by image No. 12 shown in FIG. 8A during setting for making cream puffs is started, start key 20 can be operated without operating a select key to execute the operation displayed by image No. 13.

This also applies to image Nos. 35 and 36 in FIG. 9A during setting for making the dough of cream puffs. However, the display to instruct the operation of start key 20 is not displayed or the flashing on and off of "START KEY" to call attention to a key operation is not made in image Nos. 12 and 35. Note that the surface of the start key is formed of semitransparent resin, and LEDs are placed behind the resin to light up or flash on and off.

Once the dough has been-heated in the process of making the shells of cream puffs, image No. 46 shown in FIG. 9B is displayed. The user calls image No. 47 by pressing the select key corresponding to arrow "→" in this state, then presses chef key 16 which is flashing on and off, then the operation displayed by image No. m shown in FIG. 10B is started, and as shown in FIG. 13, several kinds of illustrations are sequentially displayed for animated illustration. The display is switched at a speed equivalent to an optimum rhythm in mixing eggs into the dough. In addition, in response to the switching of the display, microcomputer 1 drives information sound generator 5 to give rhythmical sounds.

Then, the user presses the select key corresponding to "CHECKING HARDNESS OF DOUGH" displayed on liquid crystal display 9, image n for confirming the hardness of the dough is displayed. Here, several kinds of illustrations as shown in FIG. 14 are sequentially displayed, the user mixes the dough according to the sounds until the dough becomes as soft as displayed by the illustration. By pressing the select key corresponding to arrow "←", the user can return to the animated illustration by image No. m. Note that in the figures showing the contents on the display used in the foregoing description, there are some image numbers with no image displayed, because these are spare image planes created for the sake of programming.

Figure 15B:
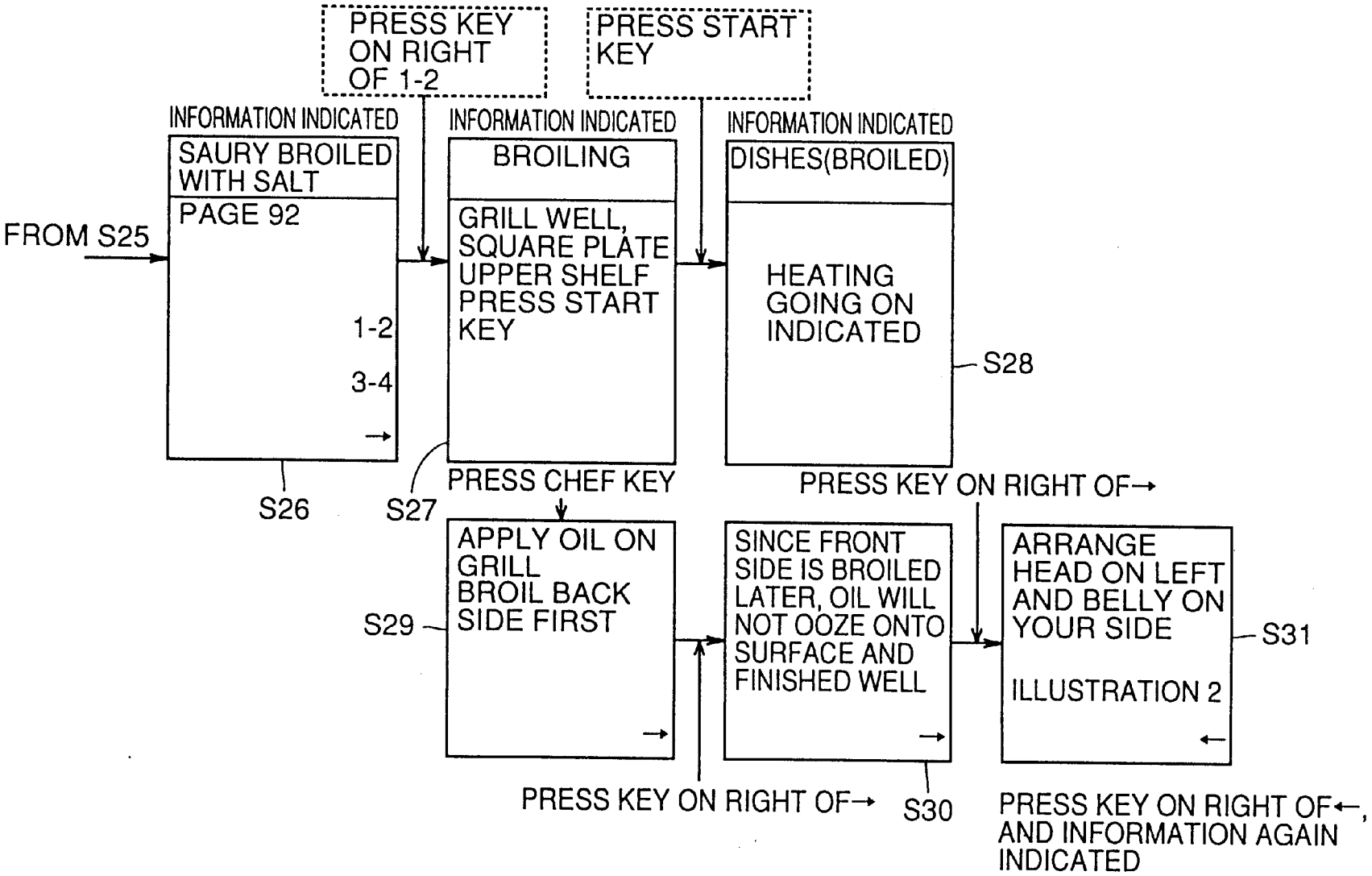

Now, how to prepare "SAURY BROILED WITH SALT" will be described as another example of automatic cooking mode. FIGS. 15A and 15B show contents displayed on liquid crystal display 9 when making the "SAURY BROILED WITH SALT" according to the sequence of the operation steps involved. In the standby state in which only the clock is displayed in liquid crystal display 9 (S20), when the user presses genre key 14*b* and selects "AUTOMATIC", microcomputer 1 detects the pressing of genre key 14*b*. Microcomputer 1 then reads out display data related to "AUTOMATIC" shown in FIGS. 15A and 15B from external memory 7, and displays the content on liquid crystal display 9 through display control circuits 8 (S21). As shown in FIGS. 15A and 15B, in the "AUTOMATIC" display state (S21), items "CONFECTIONERIES", "BREAD", "DISHES (BROILED)", "DISHES (STEAMED/BOILED)" are displayed.

The user then presses a select key on the right of liquid crystal display 9 to select "DISHES (BROILED)", and then selects "BROILED FISH" in the display state of "DISHES (BROILED)" (S22). Then, "SAURY BROILED WITH SALT" in the display state of "BROILED FISH" (S23), and the automatic cooking mode for "SAURY BROILED WITH SALT" is set (the display state of "SAURY BROILED WITH SALT" (S24)). Since start key 20 is operable after the image of "SAURY BROILED WITH SALT" (S24) is displayed, heating can be initiated at once unless the user needs information to be displayed for prearrangements.

Figure 25:
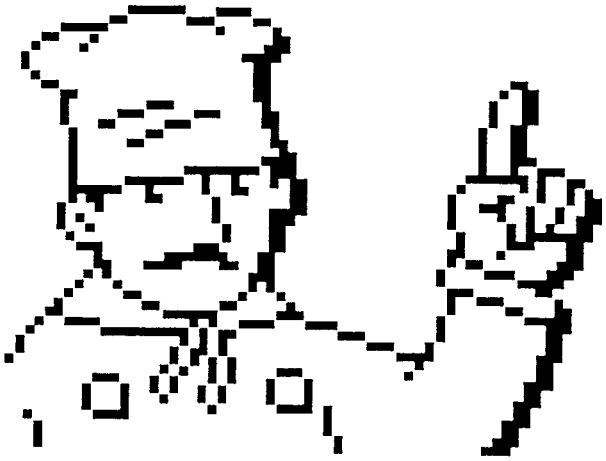
FIG. 25 shows illustration 1 indicating a chef.

When the user presses the select key on the right of "MATERIALS" in the display state of "SAURY BROILED WITH SALT" (S24), the second image for "SAURY BROILED WITH SALT" (S25) is displayed, with chef key 16 flashing on and off. If the user presses chef key 16, "SPREAD SALT ALL OVER . . . " is displayed (S32). Then by pressing the select key on the right of arrow "→", "WIPE OOZED OUT WATER" is displayed (S33), and illustration 1 in FIG. 25 is displayed, thus giving hints for prearranging materials. When the user finally presses the select key on the right of arrow "←", the second image (S25) for "SAURY BROILED WITH SALT" as above (S25) is once again displayed.

If the user presses the select key on the right of arrow "→" in this state, the first image (S24) for "SAURY BROILED WITH SALT" is once again displayed, then by pressing the select key on the right of "BROILING" in this state, the third image (S26) for "SAURY BROILED WITH SALT" is displayed. When the user presses the select key on the right of "1–2 SAURYS", "BROILING" is displayed (S27), with chef key 16 flashing on and off.

Figure 26:
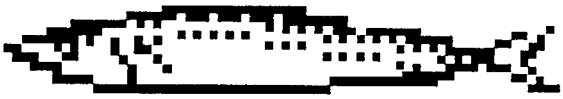
FIG. 26 is illustration 2 indicating in which direction a saury is dished up.

Then, if the user presses chef key 16, "APPLY OIL . . . " (S29) is displayed, and by pressing the key on the right of arrow "→", "FINISHED . . . " (S30) is displayed. Then the user presses the key on the right of "→", and "ARRANGE . . . ON YOUR SIDE" (S31) is displayed together with illustration 2 in FIG. 26. When the user finally presses the select key on the right of arrow "←", the "BROILING" (S27) is once again displayed. In this state, or in any of the previous states in which heating can be started, the state showing that heating is going on (S28) is displayed in response to the pressing of start key 20 by the user, and heating is started.

Thus, hints for materials, prearrangement of tools to use, and cooking are displayed, the user can smoothly cook. In addition, as the user becomes more skilled in cooking, heating may be started without such displays, in other words, the apparatus may be used in a flexible manner depending upon how skilled the user is.

(3) "JUNIOR KITCHEN" Cooking Mode

The process of making a "PORTRAIT COOKIE" will be described by way of illustrating a junior kitchen cooking mode. FIGS. 16A to 19B show contents displayed on liquid crystal display 9 in making the "PORTRAIT COOKIE" according to the sequence of operation steps involved.

Figure 16B:
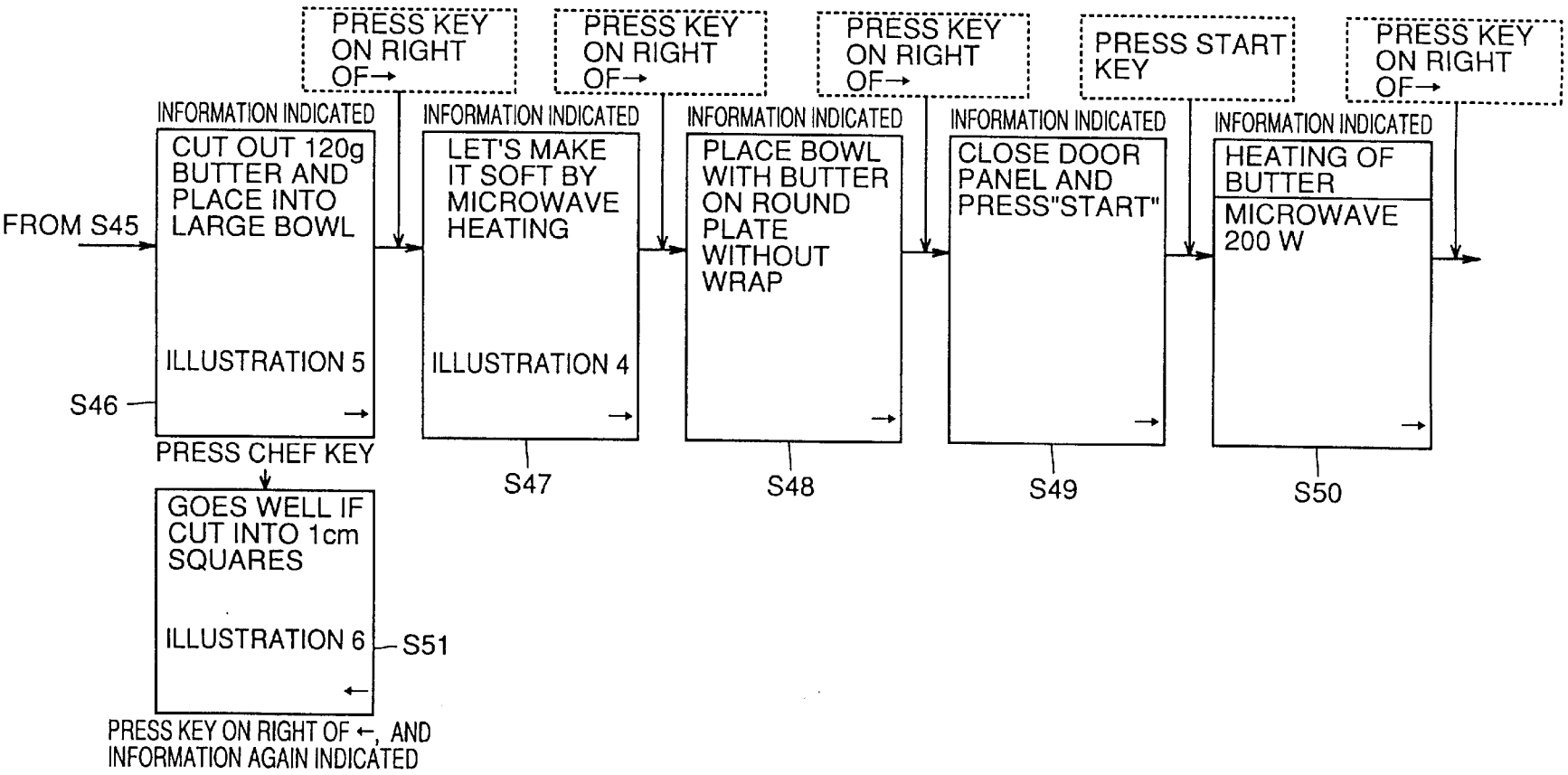

As shown in FIGS. 16A and 16B, in the standby state (S40) in which only the clock is displayed on liquid crystal display 9, when the user presses genre key 14*a* to select "JUNIOR KITCHEN", microcomputer 1 determines the pressing of genre key 14*a* and reads out display data related to the "JUNIOR KITCHEN" in FIGS. 16A and 16B from external memory 7. Microcomputer 1 then displays the content on liquid crystal display 9 through display control circuit 8. As shown in FIG. 16A, in the image of "JUNIOR KITCHEN" (S41), items "PORTRAIT COOKIE", "SOUTHERN ISLAND CUPCAKE", "PRINCESS SNOW WHITE CAKE", "KABUTO HAMBURG" (KABUTO: Japanese warrior helmet) are displayed.

Figure 27:
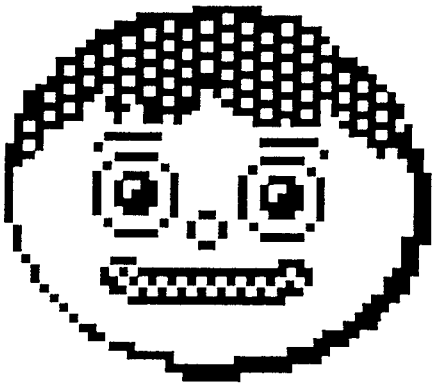
FIG. 27 is illustration 3 indicating a portrait cookie.

The user then presses the select key on the right of liquid crystal display 9 to select the "PORTRAIT COOKIE" and sets the junior kitchen cooking mode for the "PORTRAIT COOKIE" (the state displaying "PORTRAIT COOKIE" (S42)). In this state, as shown in FIG. 16A, a page corresponding to the cooking book and "WASH YOUR HANDS FIRST", and illustration 3 in FIG. 27 are displayed.

Figure 28:
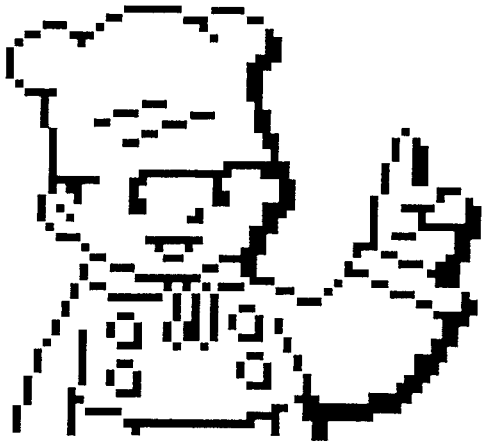
FIG. 28 is illustration 4 indicating "JUNIOR"

If in this state the user presses the select key on the right of arrow "→", "MATERIALS FOR ONE COOKIE" is displayed (S43) to show part of materials to use, and the rest of materials to use are displayed (S44) by pressing the select key on the right of "→". In this state, by further pressing the select key on the right of , "ALL MATERIALS PREPARED? LET'S START!" is displayed (S45), and then illustration 4 in FIG. 28 is displayed.

Figure 29:
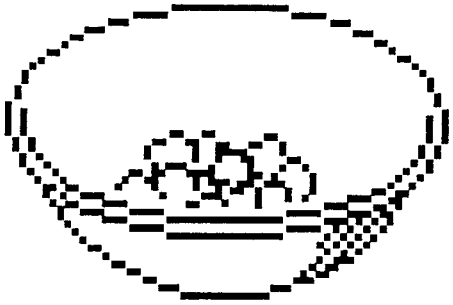
FIG. 29 is illustration 5 indicating a large bowl with pieces of butter inside.
Figure 30:
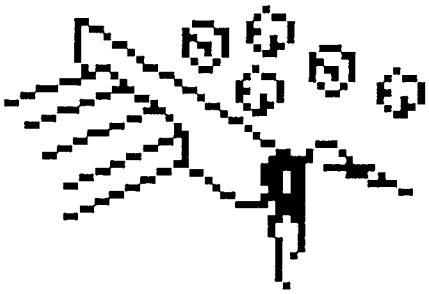
FIG. 30 is illustration 6 showing the way butter is cut into square pieces.

In this state, if the user presses the select key on the right of arrow "→", "CUT OUT . . . INTO LARGE BOWL" is displayed (S46), showing illustration 5 in FIG. 29, and chef key 16 starts flashing on and off. If the user presses chef key 16 here, "WHY DON'T YOU CUT THE BUTTER INTO 1 CM SQUARES?" is displayed (S51), and illustration 6 in FIG. 30 is displayed. Then, if the user presses the select key on the right of arrow "←", the above "CUT OUT . . . INTO LARGE BOWL" (S46) is once again displayed.

In this state, if the user presses the select key on the right of arrow "→", "LET'S MAKE IT SOFT BY MICROWAVE HEATING" is displayed (S47), and illustration 4 is displayed. Then, by pressing the select key on the right of arrow "→", "PLACE . . . WITHOUT WRAP" is displayed (S48). Then if the user further presses the select key on the right of arrow "→", "CLOSE DOOR PANEL AND PRESS "START"" is displayed (S49).

Figure 17A:
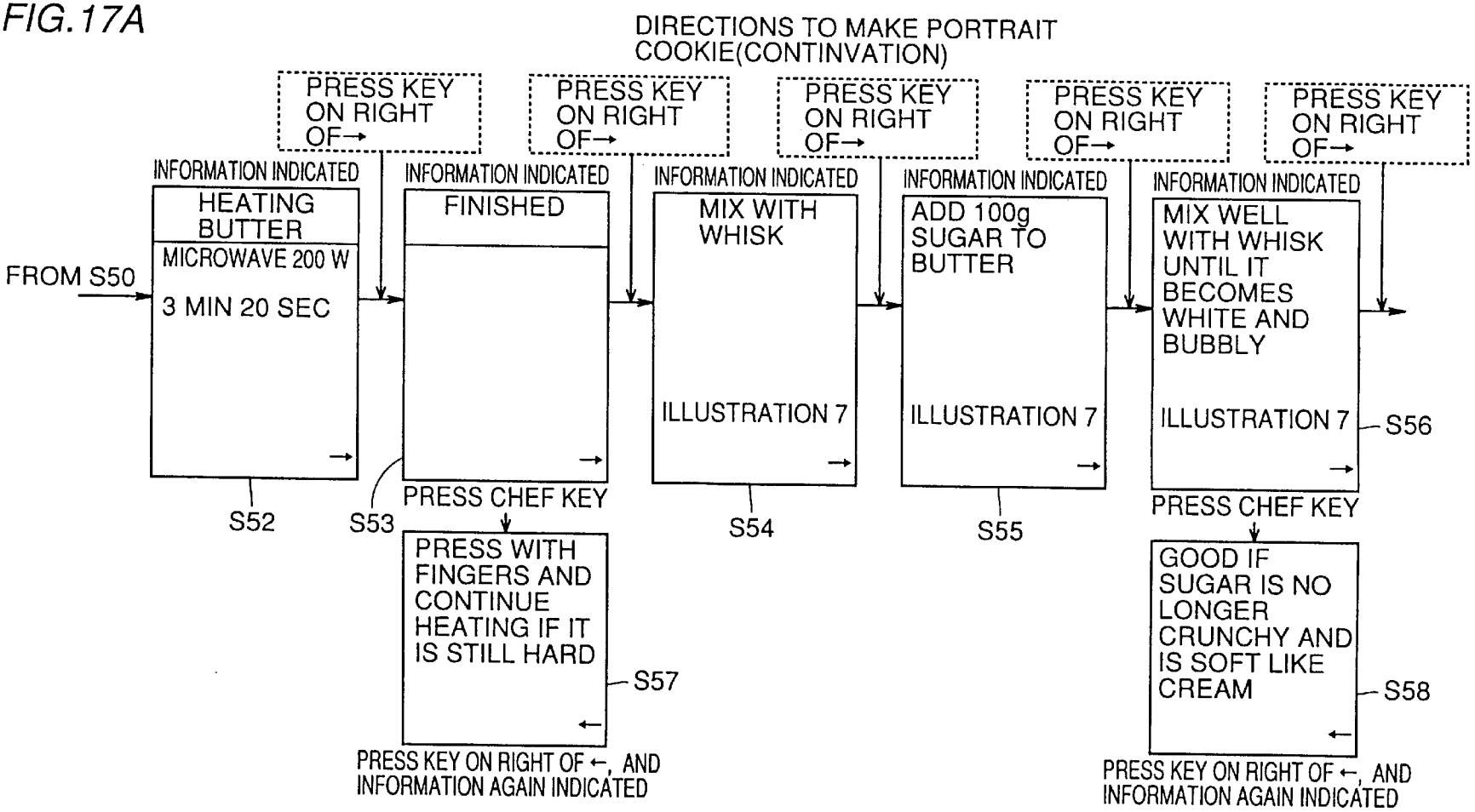
Figure 17B:
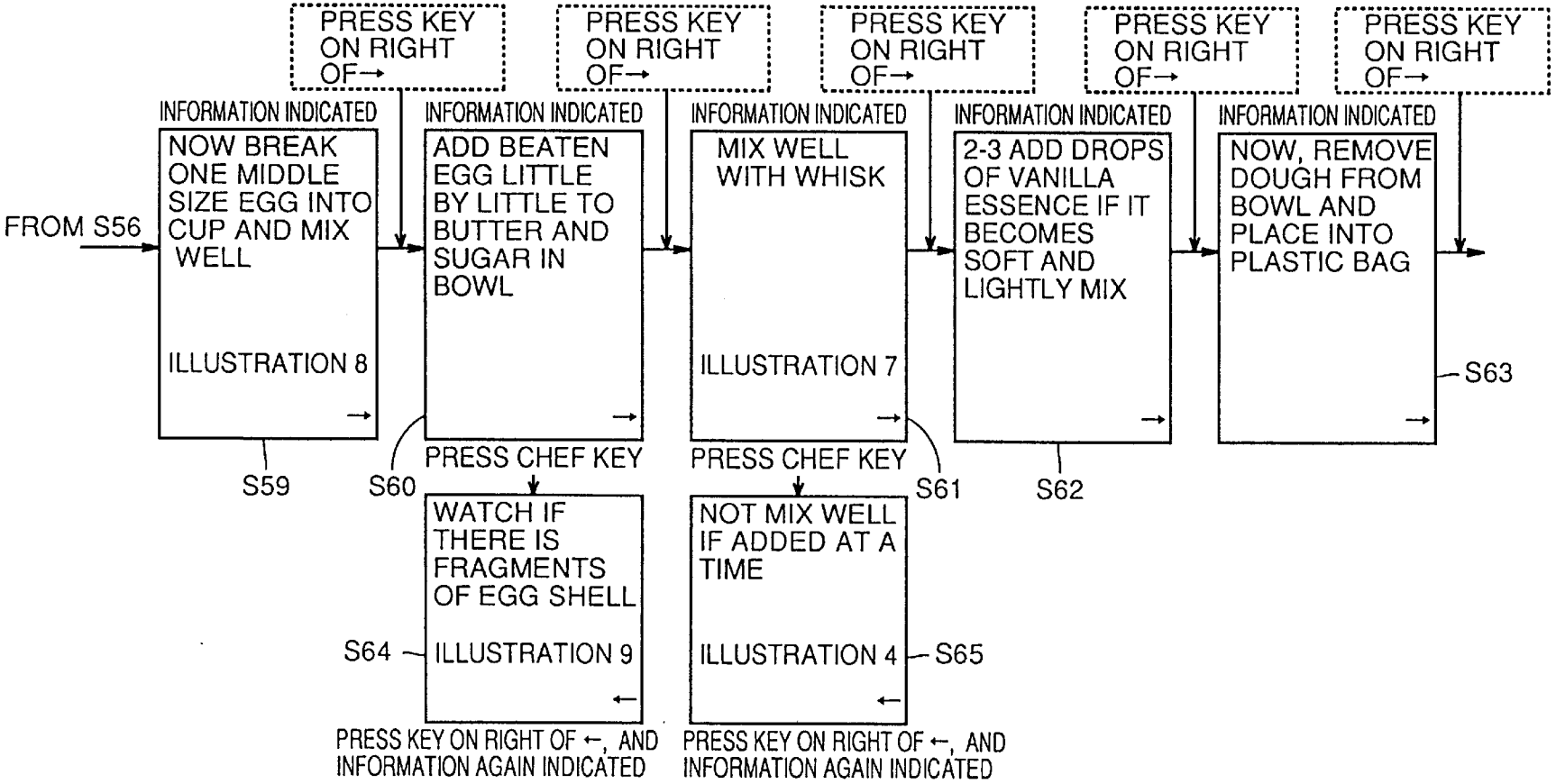

If the user presses-start key 20 in this state, "HEATING OF BUTTER" is displayed (S50), and heating is started showing the output of the microwave oven. By pressing the select key on the right of arrow "→", "HEATING OF BUTTER" (S52) in FIG. 17A is displayed as well as the heating time period. Then, if the user presses the select key on the right of arrow "→", "FINISHED" (S53) is displayed, thus completing the heating, and chef key 16 starts flashing on and off. If the user presses chef key 16 here, "PRESS WITH FINGERS . . . " (S57) is displayed. If the user presses the select key on the right of arrow "←", the "FINISHED" as above (S53) is once again displayed.

Figure 31:
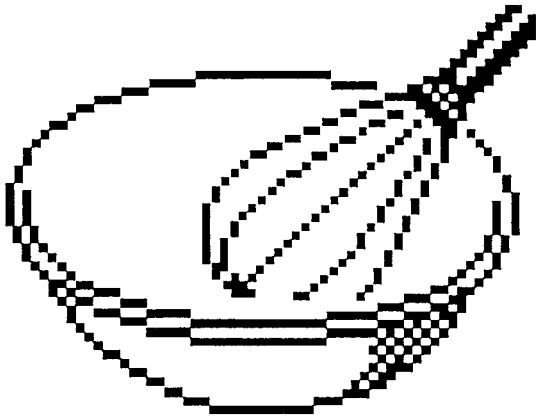
FIG. 31 is illustration 7 showing whisking with a whisk.

In this state, if the user presses the select key on the right of arrow "→", "KNEAD AND MIX WITH WHISK" (S54) is displayed together with illustration 7 in FIG. 31. By pressing the select key on the right of arrow "→", "ADD 100 G SUGAR TO BUTTER" (S55) is displayed together with illustration 7 in FIG. 31. If the user further presses the select key on the right of arrow "→", "MIX WELL WITH WHISK . . . " (S56) is displayed with illustration 7 in FIG. 31, and chef key 16 starts flashing on and off. Then if the user presses chef key 16, "GOOD IF . . . " (S58) is displayed. By pressing the select key on the right of arrow "←", "MIX WELL WITH WHISK . . . " (S56) is once again displayed.

Figure 32:
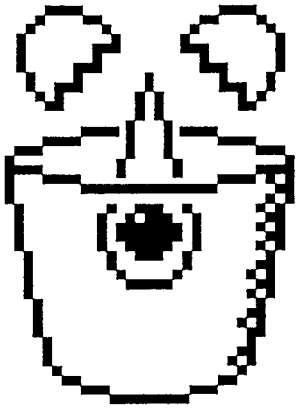
FIG. 32 is illustration 8 showing an egg is broken into a cup.
Figure 33:
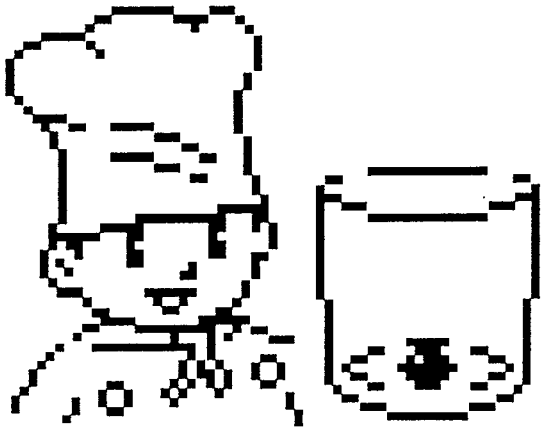
FIG. 33 is illustration 9 showing the "JUNIOR" observing the egg.

In this state, by pressing the select key on the right of arrow "→", "NOW BREAK . . . " (S59) is displayed together with illustration 8 in FIG. 32, and chef key 16 starts flashing on and off. Then if the user presses chef key 16, "WATCH IF THERE IS . . . " (S64) is displayed with illustration 9 in FIG. 33. By pressing the select key on the right of arrow "←", "NOW BREAK . . . " (S59) is once again displayed.

In this state, if the user presses the select key on the right of arrow "→", "ADD BEATEN EGG BIT BY BIT . . . " (S60) is displayed, and the chef key starts flashing on and off. If the user presses chef key 16 here, "NOT MIX WELL IF . . . " (S65) is displayed and illustration 4 shown in FIG. 28 is displayed. If the user presses the select key on the right of arrow "←", the "ADD BEATEN EGG BIT BY BIT . . . " (S60) is once again displayed.

In this state, if the user presses the select key on the right of arrow "→", "MIX WELL WITH WHISK" (S61) is displayed together with illustration 7 in FIG. 31. By pressing the select key on the right of arrow "→", " . . . IF IT BECOMES NICE AND SOFT, . . . LIGHTLY MIX" (S62) is displayed, and by pressing the select key on the right of arrow "→", "NOW REMOVE . . . " (S63) is displayed.

Figure 18A:
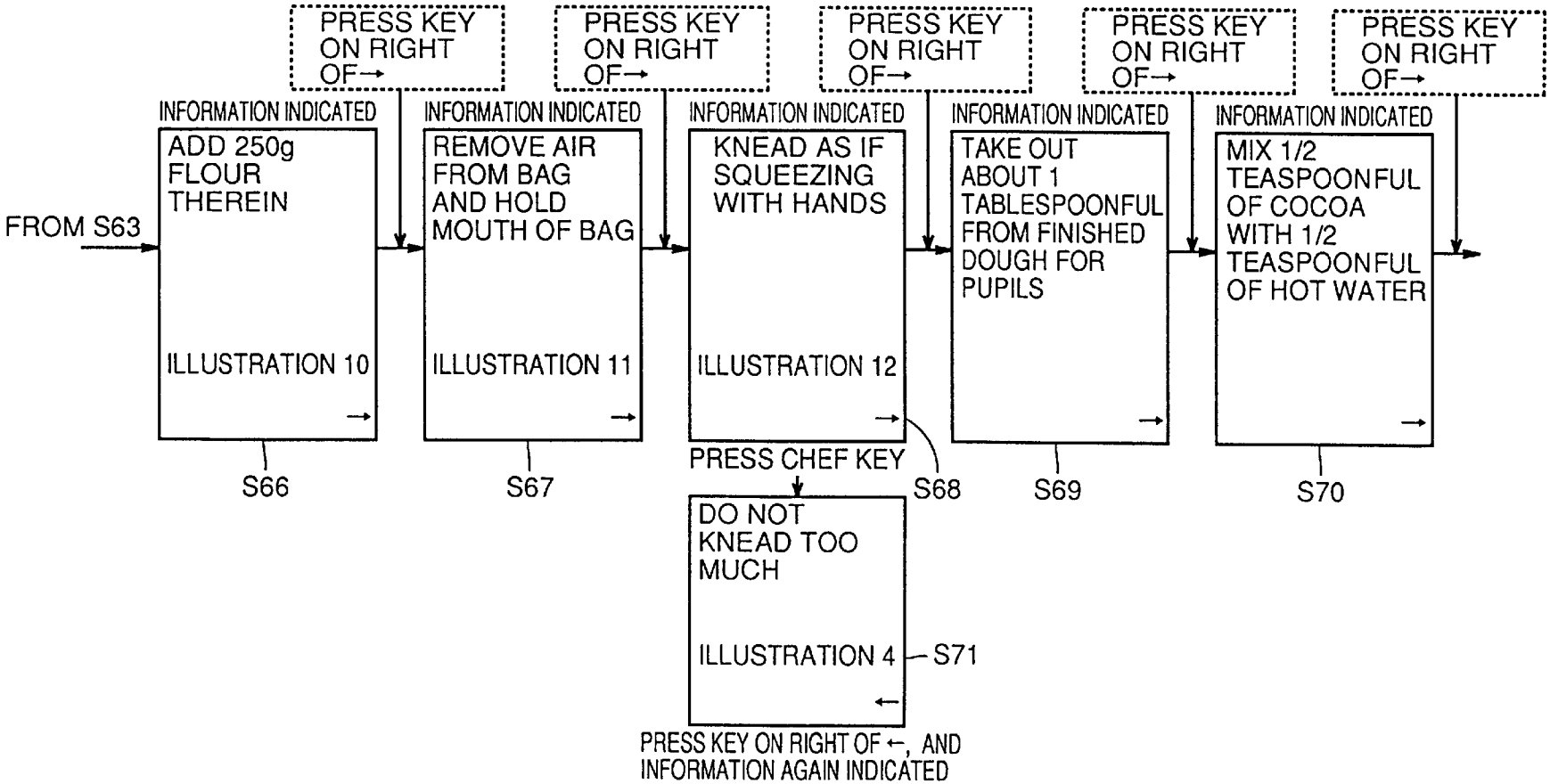
Figure 18B:
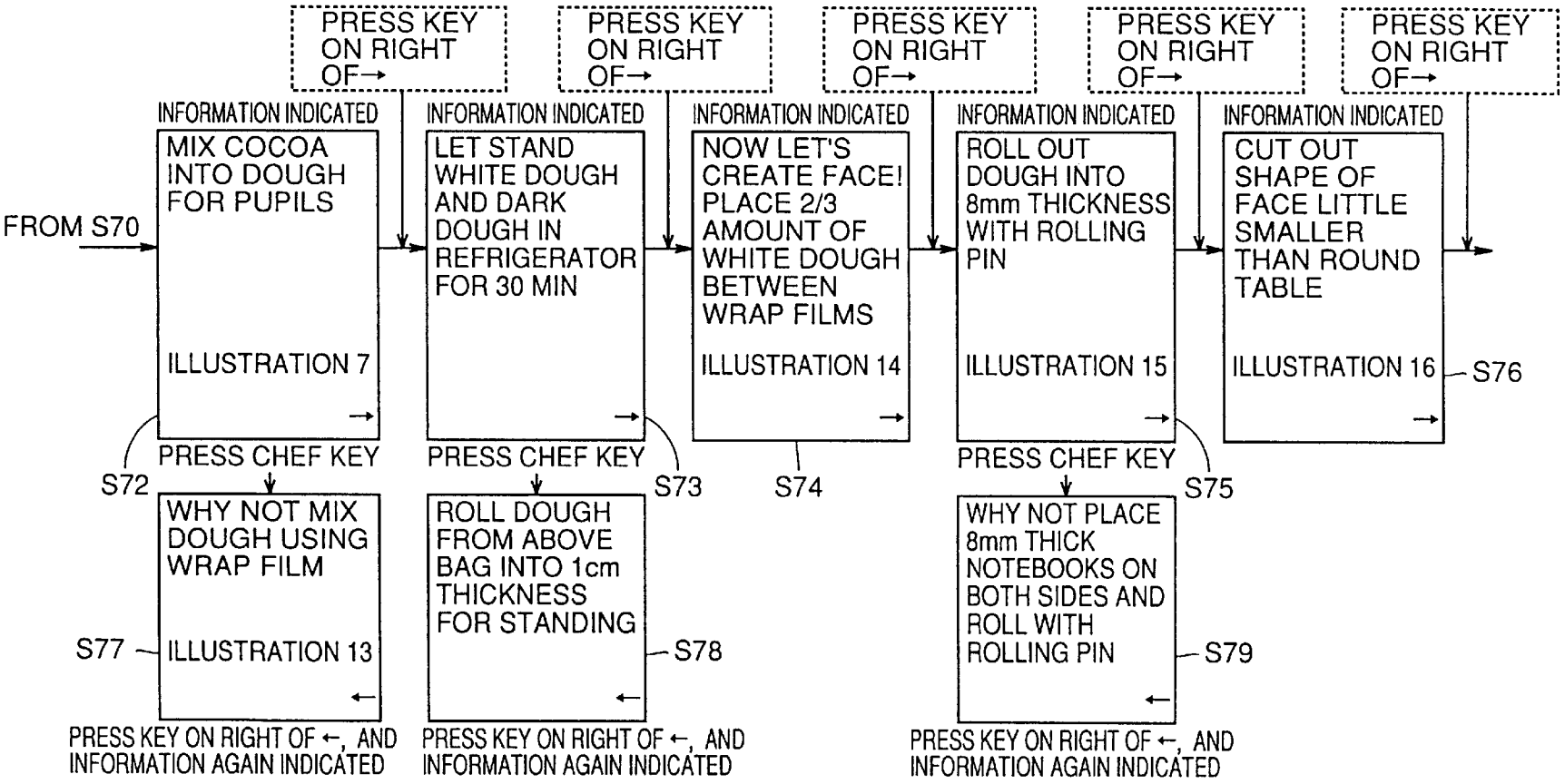
Figure 34:
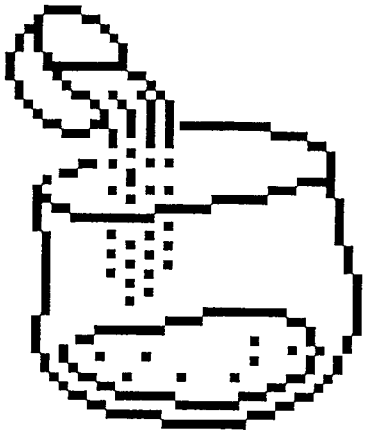
FIG. 34 is illustration 10 showing flour put into a plastic bag.
Figure 35:
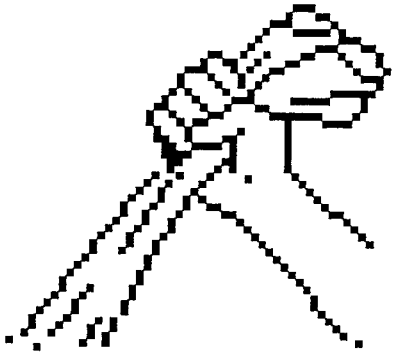
FIG. 35 is illustration 11 showing a hand holding the plastic bag.
Figure 36:
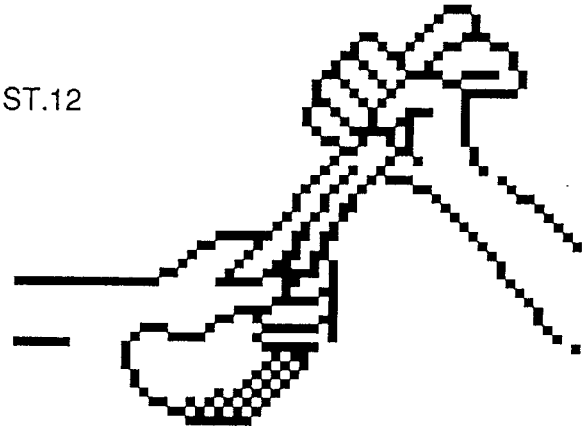
FIG. 36 is illustration 12 showing how the flour is squeezed and mixed by hands.

Then, if the user presses the select key on the right of arrow "→", "ADD . . . THEREIN" (S66) in FIG. 18A is displayed together with illustration 10 in FIG. 34. If the user presses the select key on the right of arrow "→", "REMOVE AIR FROM BAG AND HOLD MOUSE OF BAG" (S67) is displayed with illustration 11 shown in FIG. 35. By pressing the select key on the right of arrow "→", "KNEAD AS IF SQUEEZING WITH HANDS" (S68) is displayed together with illustration 12 in FIG. 36, and chef key 16 starts flashing on and off. If the user presses chef key 16 here, "DO NOT KNEAD TOO MUCH" (S71) is displayed as well as illustration 4 in FIG. 28. If the user presses the select key on the right of arrow "←", the above "MIX BY KNEAD AS IF SQUEEZING WITH HANDS" (S68) is once again displayed.

Figure 37:
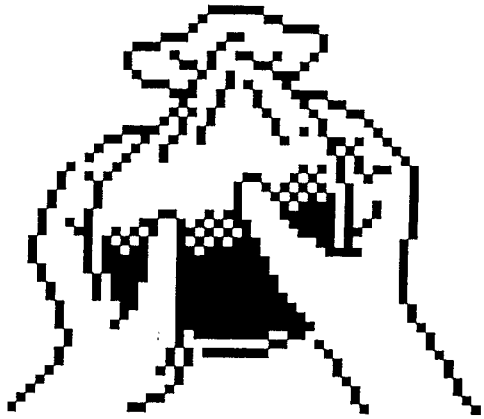
FIG. 37 is illustration 13 showing wrapping and mixing.

If the user presses the select key on the right of arrow "→" in this state, "TAKE OUT ABOUT, . . . " (S69) is displayed, and further by pressing the select key on the right of arrow "→", "MIX ½ . . . " (S70) is displayed. Then if the user presses the select key on the right of arrow "→", "MIX COCOA INTO . . . " (S72) is displayed with illustration 7 in FIG. 31 and chef key 16 starts flashing on and off. If the user presses chef key 16 here, "WHY NOT MIX . . . " (S77) is displayed as well as illustration 13 in FIG. 37. By pressing the select key on the right of arrow "←", "MIX COCOA . . . " (S72) is once again displayed.

If the user presses the select key on the right of arrow "→" in this state, "LET STAND . . . " (S73) is displayed, and the chef key starts flashing on and off. By pressing chef key 16, "ROLL DOUGH FROM . . . " (S78) is displayed. Then if the user presses the select key on the right of arrow "←", "LET STAND . . . " (S73) is once again displayed.

Figure 38:
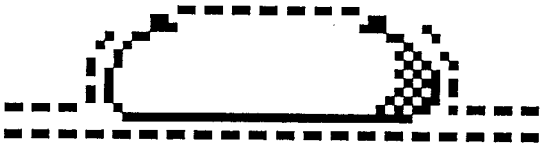
FIG. 38 is illustration 14 showing dough placed between plastic wraps.
Figure 39:
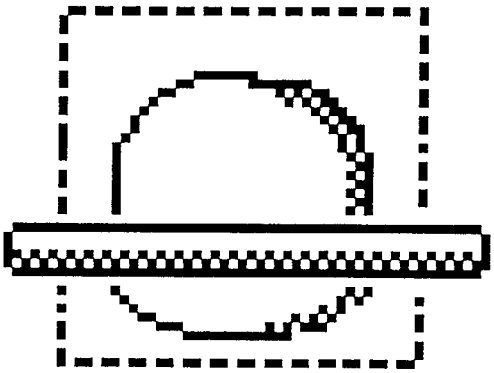
FIG. 39 is illustration 15 showing dough flattened by a rolling pin.

If the user presses the select key on the right of arrow "→" in this state, "LET'S CREATE FACE! . . . " (S74) is displayed as well as illustration 14 in FIG. 38. If the user presses the select key on the right of arrow "→", "ROLL OUT . . . WITH ROLLING PIN" (S75) is displayed as well as illustration 15 in FIG. 39, and chef key 16 starts flashing on and off. If the user presses chef key 16 here, "WHY NOT . . . " (S79) is displayed. Then, if the user presses the select key on the right of arrow "←", the above "ROLL OUT . . . WITH ROLLING PIN" (S75) is once again displayed.

Figure 19A:
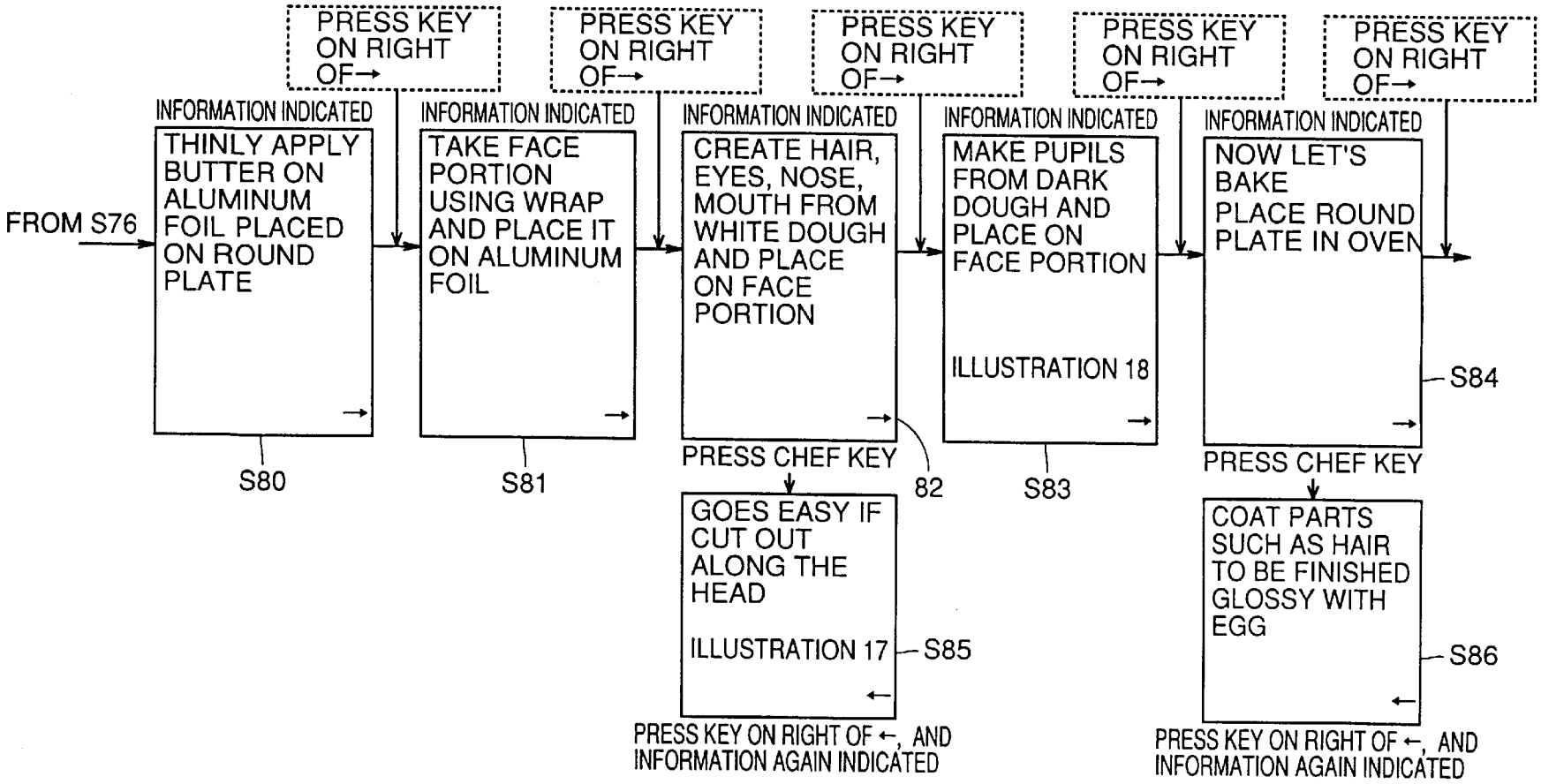
Figure 19B:
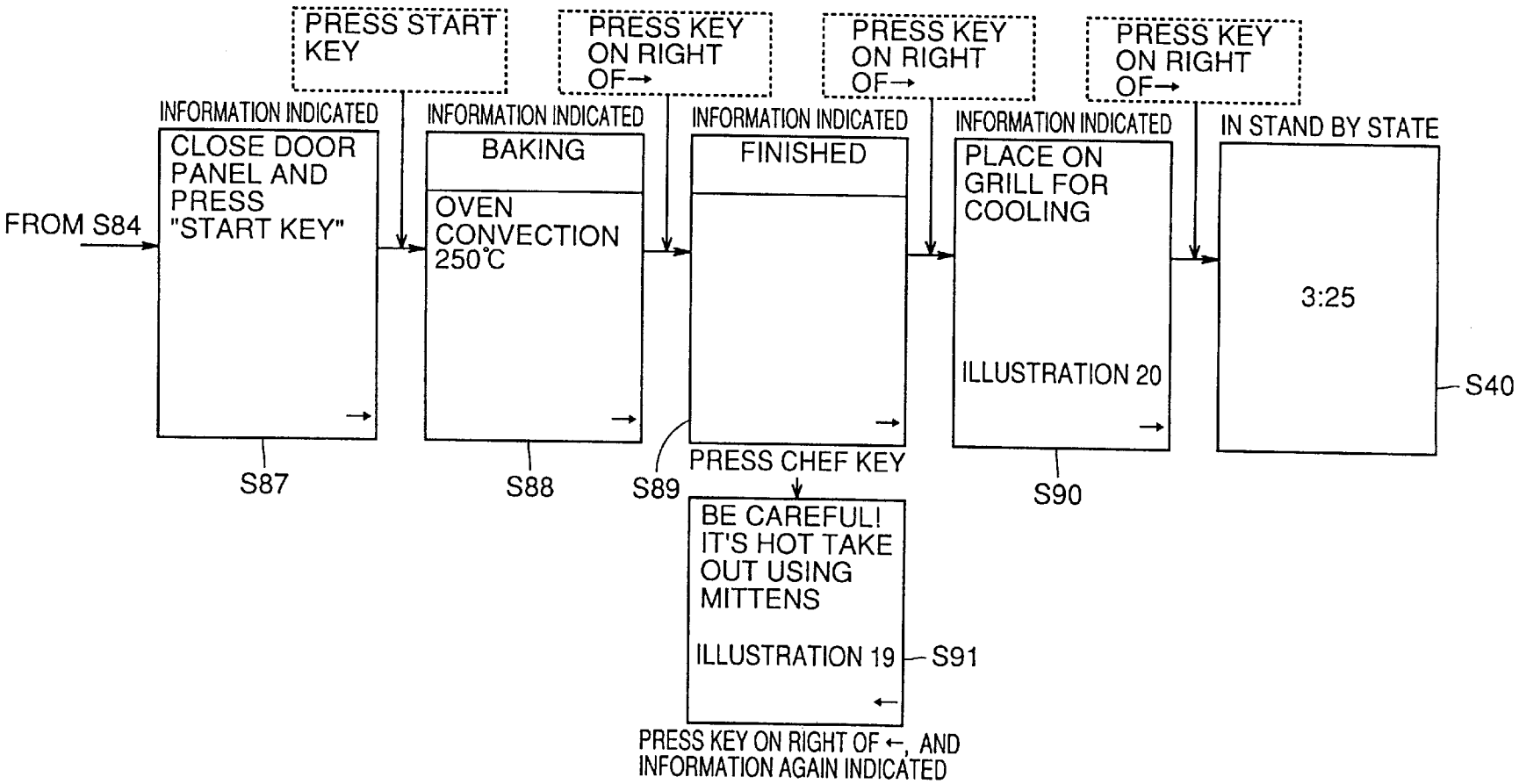
Figure 40:
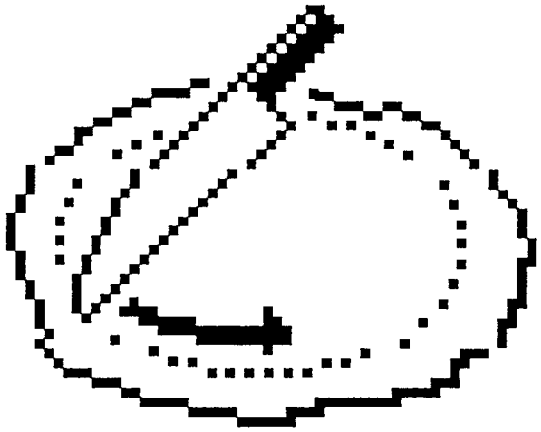
FIG. 40 is illustration 16 showing how the dough is cut out into the shape of a face.
Figure 41:
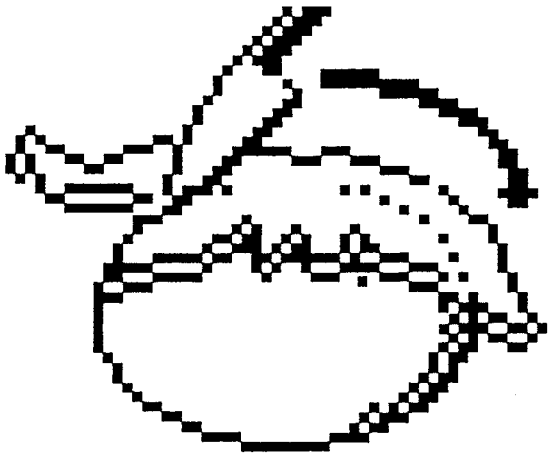
FIG. 41 is illustration 17 showing how to remove an excess amount of the hair portion.

If the user presses the select key on the right of arrow "→" in this state, "CUT OUT SHAPE OF FACE . . . " (S76) is displayed as well as illustration 16 in FIG. 40. Then by pressing the select key on the right of arrow "→", "THINLY APPLY BUTTER . . . " (S80) in FIG. 19A is displayed. Then if the user presses the select key on the right of arrow "→", "TAKE FACE PORTION . . . " (S81) is displayed. Then, if the user presses select key on the right of arrow "→", "CREATE HAIR, EYES, NOSE . . . " (S82), and the chef key 16 starts flashing on and off. If the user presses chef key 16, "GOES EASY IF CUT OUT . . . " (S85) is displayed as well as illustration 17 in FIG. 41. If the user presses the select key on the right of arrow "←", "NOW PLACE ON . . . " (S82) is once again displayed.

Figure 42:
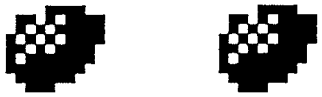
FIG. 42 is illustration 18 showing portions corresponding to pupils.

If the user presses the select key on the right of arrow "→" in this state, "MAKE PUPILS . . . " (S83) is displayed as well as illustration 18 in FIG. 42. If the user further presses the select key on the right of arrow "→", "NOW LET'S BAKE . . . " is displayed (S84), and chef key 16 starts flashing on and off. If the user presses chef key 16, "PARTS SUCH AS HAIR TO BE FINISHED GLOSSY. . . " is displayed (S86). Then the user presses the select key on the right of arrow "←", the above "NOW LET'S BAKE . . . " is once again displayed (S84).

Figure 43:
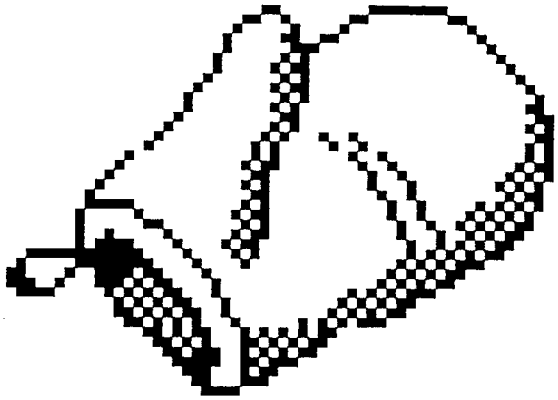
FIG. 43 is illustration 19 showing a mitten.

If the user presses the select key on the right of arrow "→" in this state, "CLOSE DOOR PANEL AND . . . " is displayed (S87). By pressing start key 20, "BAKING" is displayed (S88), and heating is started displaying "OVEN CONVECTION" and its temperature. By pressing the select key on the right of arrow "→", "FINISHED" is displayed (S89), completing the heating, and chef key 16 starts flashing on and off. If the user presses chef key 16, "BE CAREFUL! IT'S HOT. TAKE OUT USING MITTENS" is displayed (S91) as well as illustration 19 in FIG. 43. Then the user presses the select key on the right of arrow "←" and the above "FINISHED" is again displayed (S89).

Figure 44:
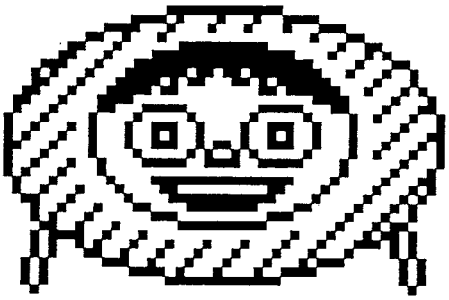
FIG. 44 is illustration 20 showing the cookie placed on a grill.

In this state, if the user presses the select key on the right of arrow "→", "COOL OFF ON GRILL" is displayed (S90) together with illustration 20 in FIG. 44, and by pressing the select key on the right of arrow "→", the display returns to the initial standby state (S40).

As described above, also in the junior kitchen cooking mode, by pressing chef key 16, convenient information such as cooking hints is available. In addition, this mode is for children in their ages to start having interests in cooking, for example, and only simple and easy words or sentences are used for display, so that a children can remember information related to a menu he/she has interest in.

Other than the cooking mode dedicated to children as described above, there may be separately provided cooking modes displaying cooking methods in expressions more simple than other groups and select keys for selecting the modes for aged people, people living by themselves and not familiar with cooking, people who are interested in cooking yet feel it cumbersome to read and understand cooking methods. Thus, numerous variations can be set by accounting for modes and items directed to people of a particular age group or for a particular purpose, and the apparatus have large potentialities.

Figure 20:
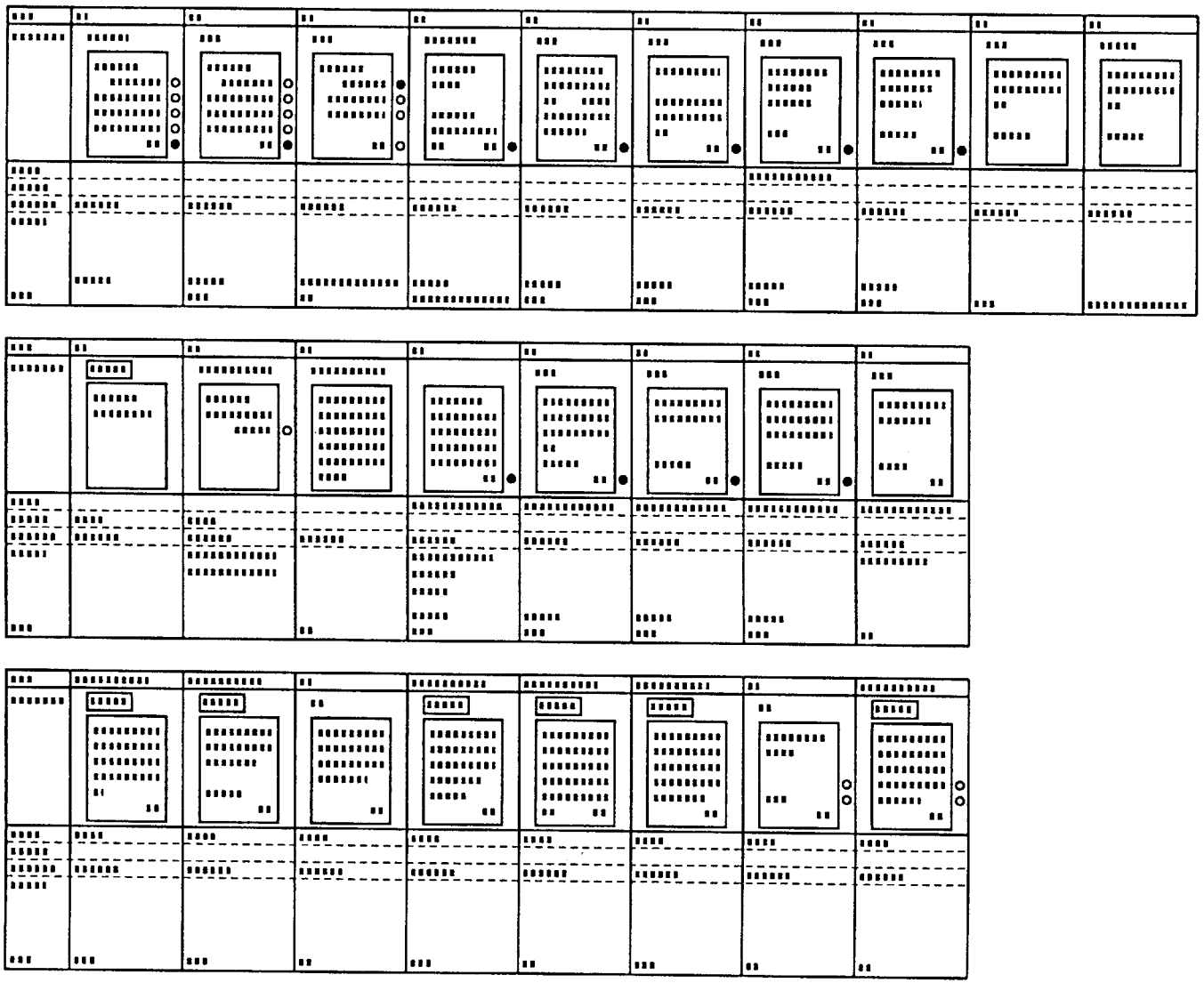
FIG. 20 shows another example of content indicated on the display of the cooking apparatus according to the invention in the junior kitchen cooking mode.

FIG. 20 shows contents displayed when "GLITTERING CANDIES" is made as another example of junior kitchen cooking mode. In the standby state in which only the clock is displayed on liquid crystal display 9, when the user presses genre key 14*a* corresponding to "JUNIOR KITCHEN", microcomputer 1 determines that the "JUNIOR KITCHEN" is selected in response to the output signal of key circuit 3. Display data corresponding to the "JUNIOR KITCHEN" mode is read out from external memory 7, temporarily stored in display-dedicated memory 8*a* in display control circuit 8, and the content of image No. 1 in FIG. 20 is displayed on liquid crystal display 9.

In this display state, if the user presses twice the select key corresponding to the position of "→" on liquid crystal display, image No. 3 is displayed on liquid crystal display 9, and then "GLITTERING CANDIES" is selected by the select key.

Thereafter, desired or necessary select keys corresponding to displays on liquid crystal display 9 are sequentially operated. The operations are similar to those described in conjunction with the above "PORTRAIT COOKIE", and therefore a detailed description thereof is not repeated here. Display data related to dishes which children like and become interested in are stored in the genre of the "JUNIOR KITCHEN" in external memory 7 or the internal memory Id of microcomputer 1. Directions are given in a more simple manner than other genres, which make it easy for even elementary school children who become interested in cooking to understand.

(4) "Usual" Cooking Mode

Figure 21A:
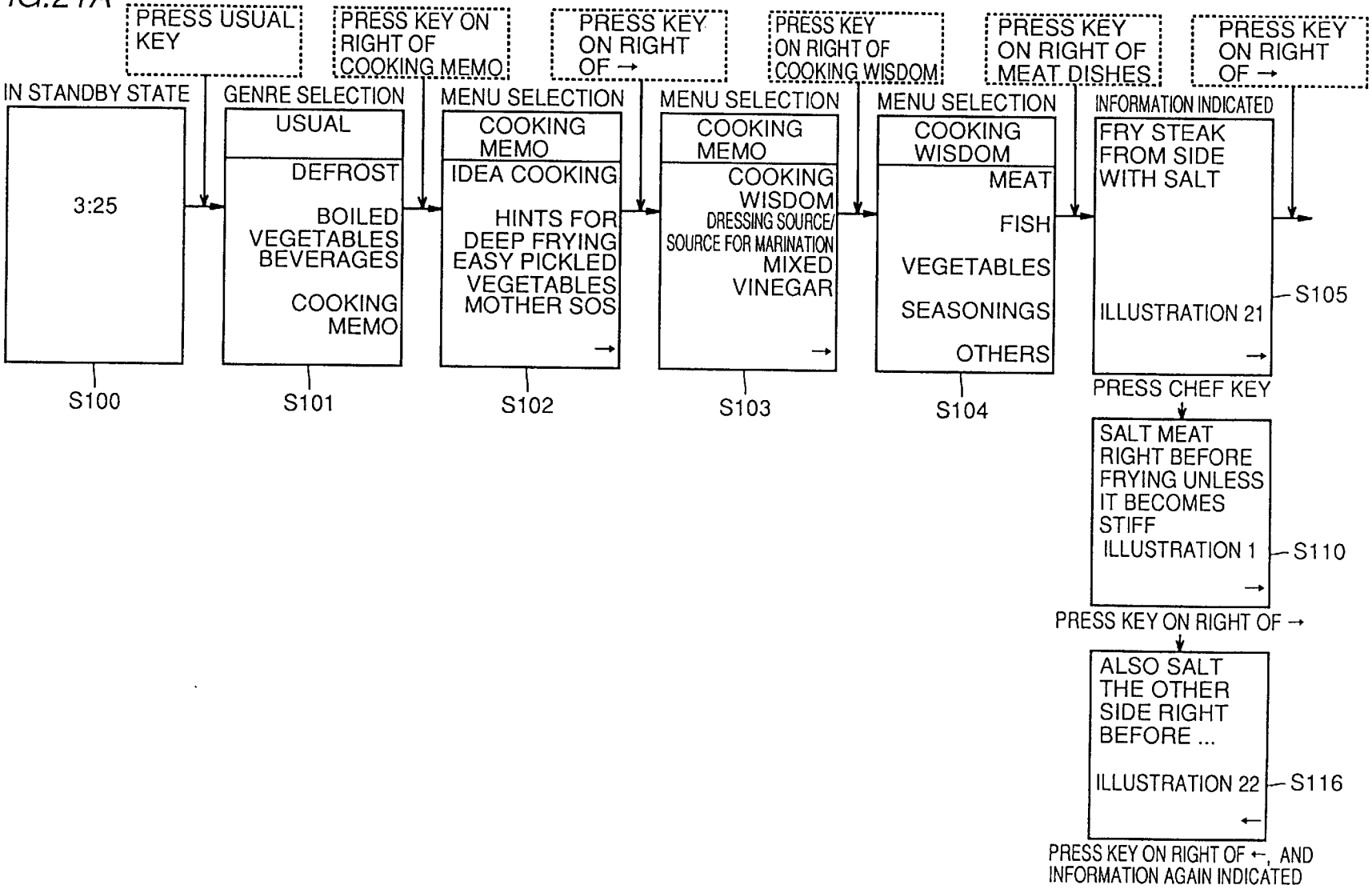
FIGS. 21A and 21B show an example of content on the display of the cooking apparatus according to the invention in a usual cooking mode.
Figure 21B:
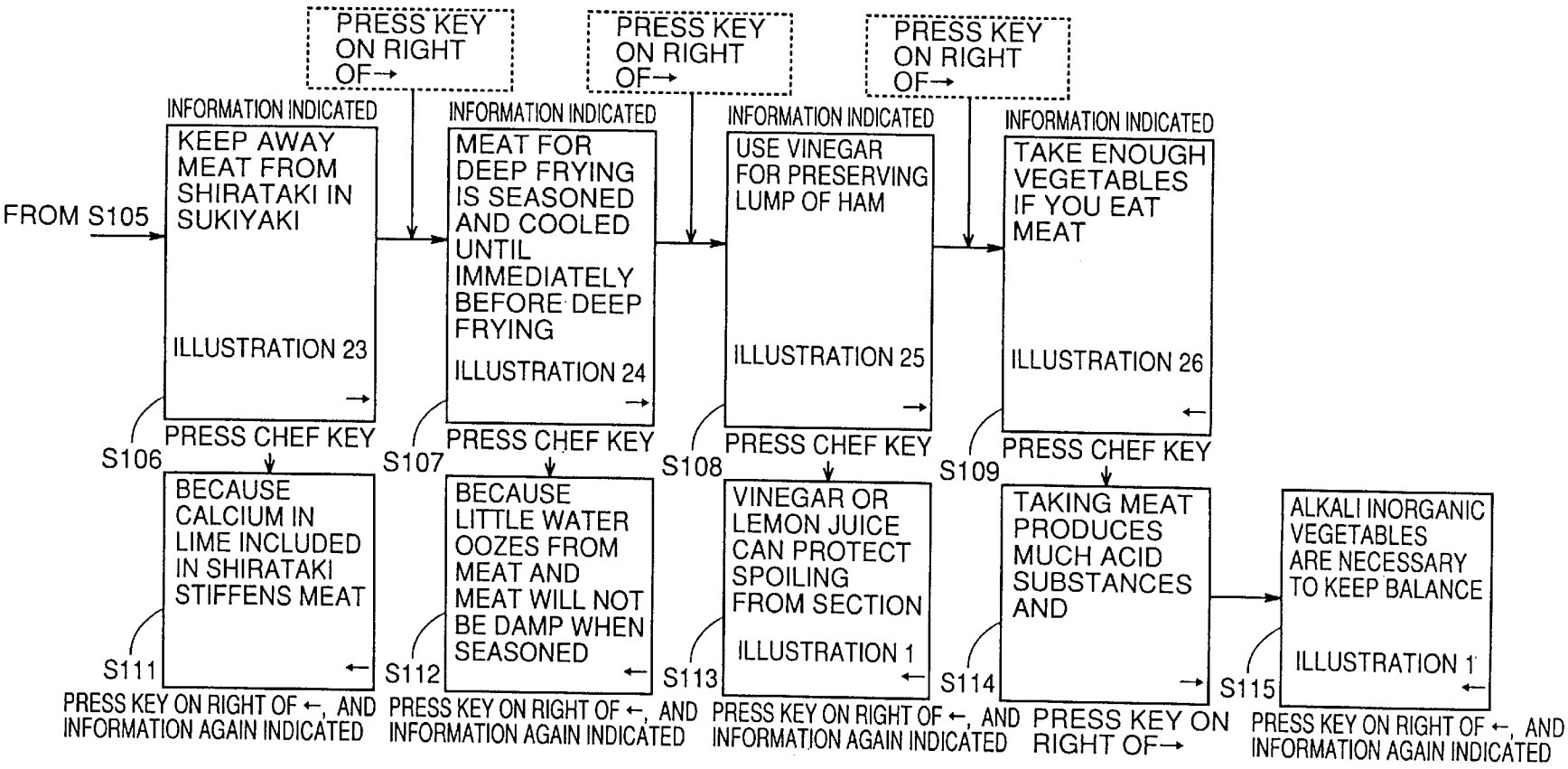

In the usual cooking mode, in addition to often used items such as "BEVERAGES" and "DEFROST", convenient cooking information can be displayed irrespective of the presence/absence of relation with cooking by the microwave oven. For example, FIGS. 21A and 21B sequentially shows contents displayed on liquid crystal display 9 when calling "MEAT DISH" from "COOKING WISDOM" from item "COOKING MEMOS" selected from "USUAL" cooking mode.

First, in the standby state in which only the clock is displayed on liquid crystal display 9 (S100), the user selects the "USUAL" by pressing genre key 14*c*, and microcomputer 1 determines the pressing of genre key 14*c*. Then, microcomputer 1 reads out display data related to the "USUAL" in FIG. 21A from external memory 7, and displays the contents on liquid crystal display 9. As described in FIG. 21A, under "USUAL" (S101), "DEFROST", "BOILING VEGETABLES", "BEVERAGES" and "COOKING MEMOS" are displayed.

Figure 45:
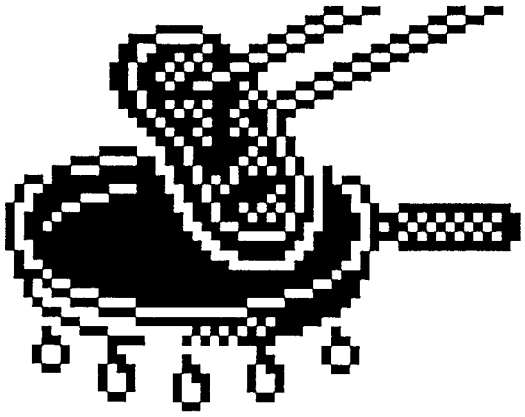
FIG. 45 is illustration 21 showing a steak being fried.
Figure 46:
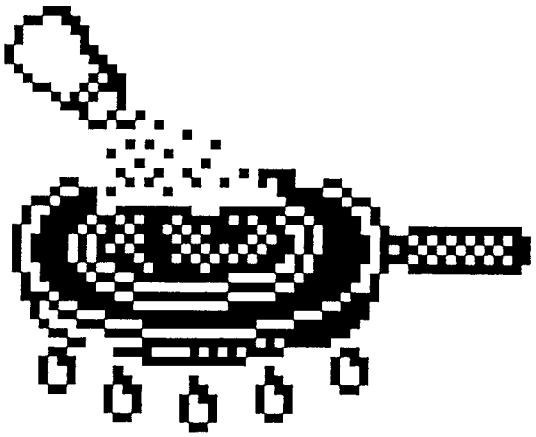
FIG. 46 is illustration 22 showing the steak being salted.

Then, the user presses the select key on the right of liquid crystal display 9, selects "COOKING MEMOS", and presses the select key on the right of arrow "→" to call the remaining items of "COOKING MEMOS". The user selects "COOKING WISDOM" in this state (S103), and selects "MEAT" in "COOKING WISDOM" (S104), thereby calling out cooking information included in "MEAT". Herein, "FRY STEAK FROM SIDE WITH SALT" (S105) is displayed together with illustration 21 in FIG. 45, and chef key 16 starts flashing on and off. Then, if the user presses chef key 16, "SALT MEAT RIGHT BEFORE FRYING UNLESS MEAT BECOMES STIFF" is displayed (S110) as well as illustration 1 in FIG. 25. If the user further presses the select key on the right of arrow "→", "ALSO SALT THE OTHER SIDE RIGHT BEFORE . . . " is displayed (S116) as well as illustration 22 in FIG. 46. Then, if the user presses the select key on the right of arrow "←", "FRY STEAK FROM SIDE WITH SALT" is once again displayed (S105).

Figure 47:
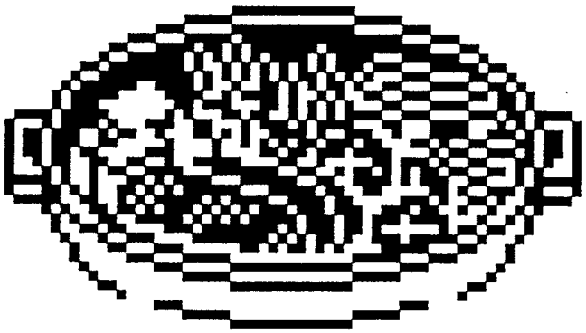
FIG. 47 is illustration 23 showing Sukiyaki.

In this state, by pressing the select key on the right of arrow "→", "KEEP AWAY MEAT FROM SHIRATAKI IN COOKING SUKIYAKI" (SHIRATAKI: translucent white noodles made from Konnyaku) is displayed (S106) together with illustration 23 in FIG. 47, and the chef key starts flashing on and off. If the user presses chef key 16 here, "BECAUSE CALCIUM IN LIME INCLUDED IN SHIRATAKI STIFFENS MEAT" is displayed (S111). Then, if the user presses the select key on the right of "←", "KEEP AWAY MEAT FROM . . . " is once again displayed (S106).

Figure 48:
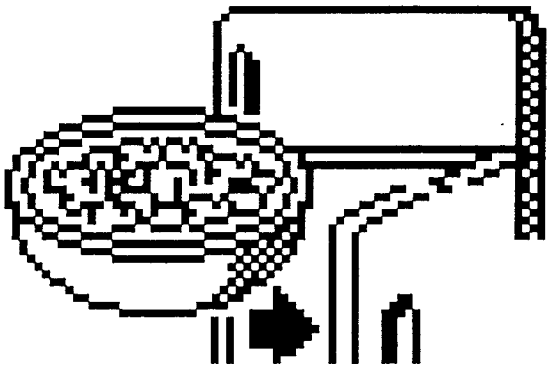
FIG. 48 is illustration 24 showing a material for deep frying without batter being put into a refrigerator.

In this state, if the user presses the select key on the right of arrow "→", "MEAT FOR DEEP FRYING . . . " is displayed (S107) together with illustration 24 in FIG. 48, and the chef key starts flashing on and off. If the user presses chef key 16, "BECAUSE LITTLE WATER OOZES FROM MEAT . . . " (S112) is displayed. Then, by pressing the select key on the right of arrow "←", the above "MEAT FOR . . . " is once again displayed (S107).

Figure 49:
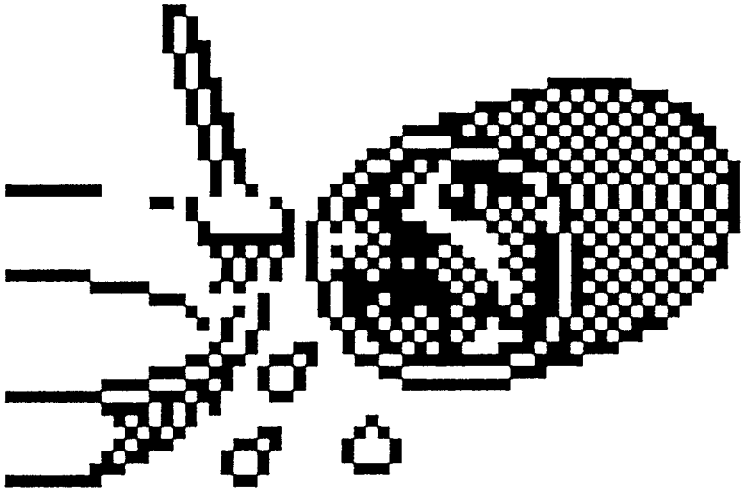
FIG. 49 is illustration 25 showing ham being coated with vinegar.

In this state, by pressing the select key on the right of arrow "→", "USE VINEGAR . . . " is displayed (S108) together with illustration 25 in FIG. 49, and the chef key starts flashing on and off. If the user presses chef key 16, "VINEGAR OR LEMON JUICE CAN . . . " is displayed (S113) together with illustration 1 in FIG. 25. If the user presses the select key on the right of arrow "←", the above "USE VINEGAR . . . " is once again displayed (S108).

Figure 50:
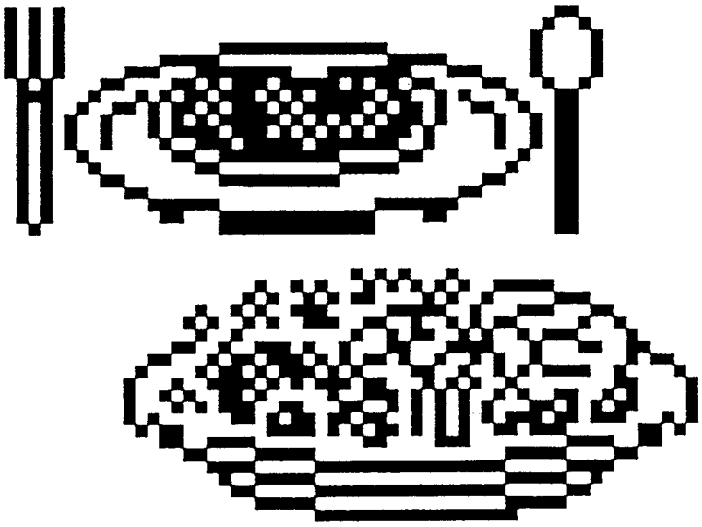
FIG. 50 is illustration-26 showing a meat dish and a vegetable dish being served.

If the user presses the select key on the right of arrow "→" in this state, "TAKE ENOUGH VEGETABLES . . . " is displayed (S109) together with illustration 26 in FIG. 50, and the chef key starts flashing on and off. If the user presses chef key 16 here, "TAKING MEAT PRODUCES MUCH ACID SUBSTANCES . . . " is displayed (S114). By pressing the select key on the right of arrow "→", "ALKALI INORGANIC VEGETABLES . . . " is displayed (S115) together with illustration 1 in FIG. 25. By pressing the select key on the right of arrow "←", the above "TAKE ENOUGH VEGETABLES . . . " is once again displayed (S109). If the user presses the select key on the right of arrow "←" in this state, the display returns to the above "COOKING WISDOM" or "COOKING MEMOS" (S102, S104). Alternatively, "USUAL" (S101) or the standby state (S107) may be displayed.

Figure 22A:
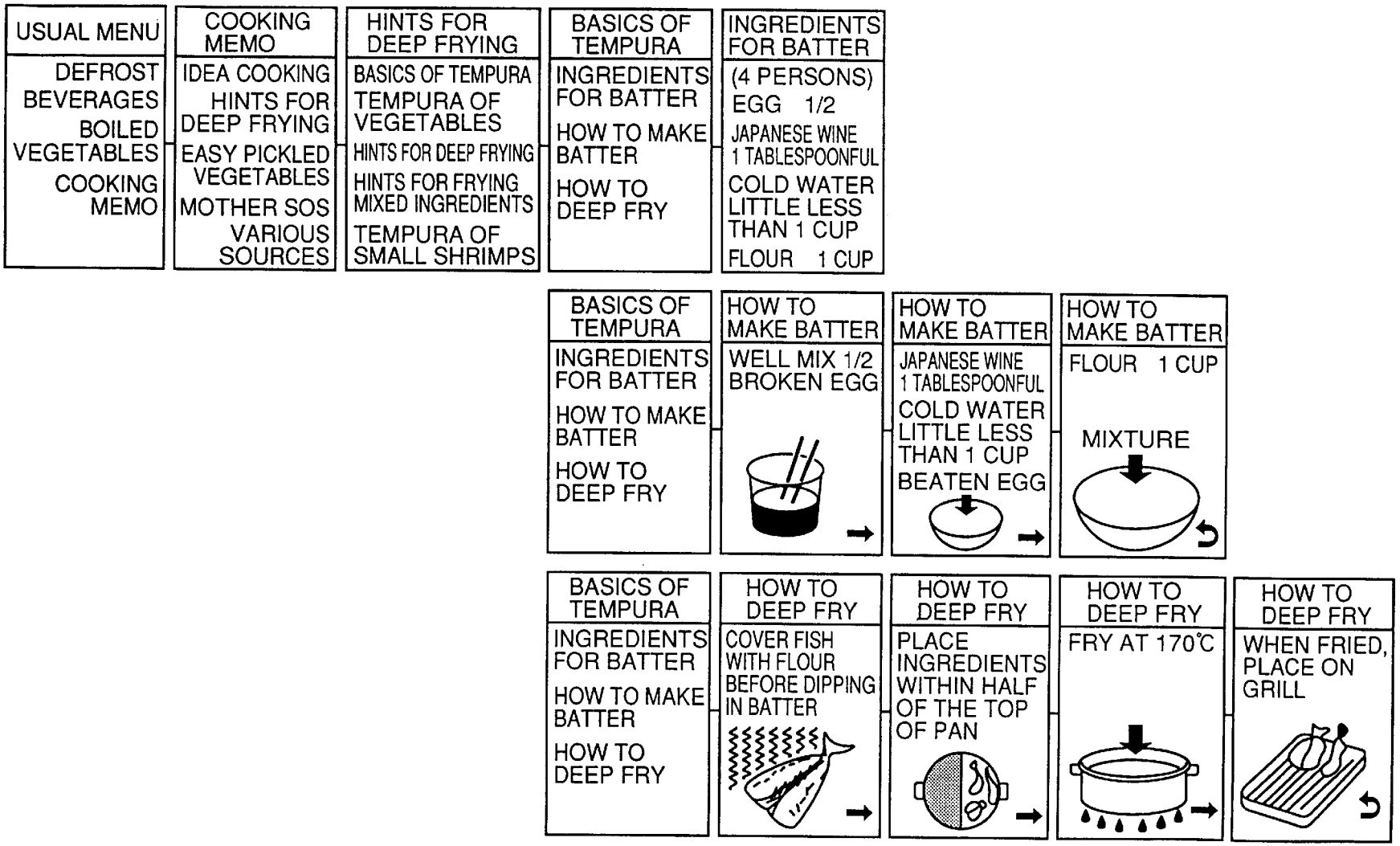
FIGS. 22A and 22B show another example of content on the display of the cooking apparatus according to the invention in the usual cooking mode.
Figure 22B:
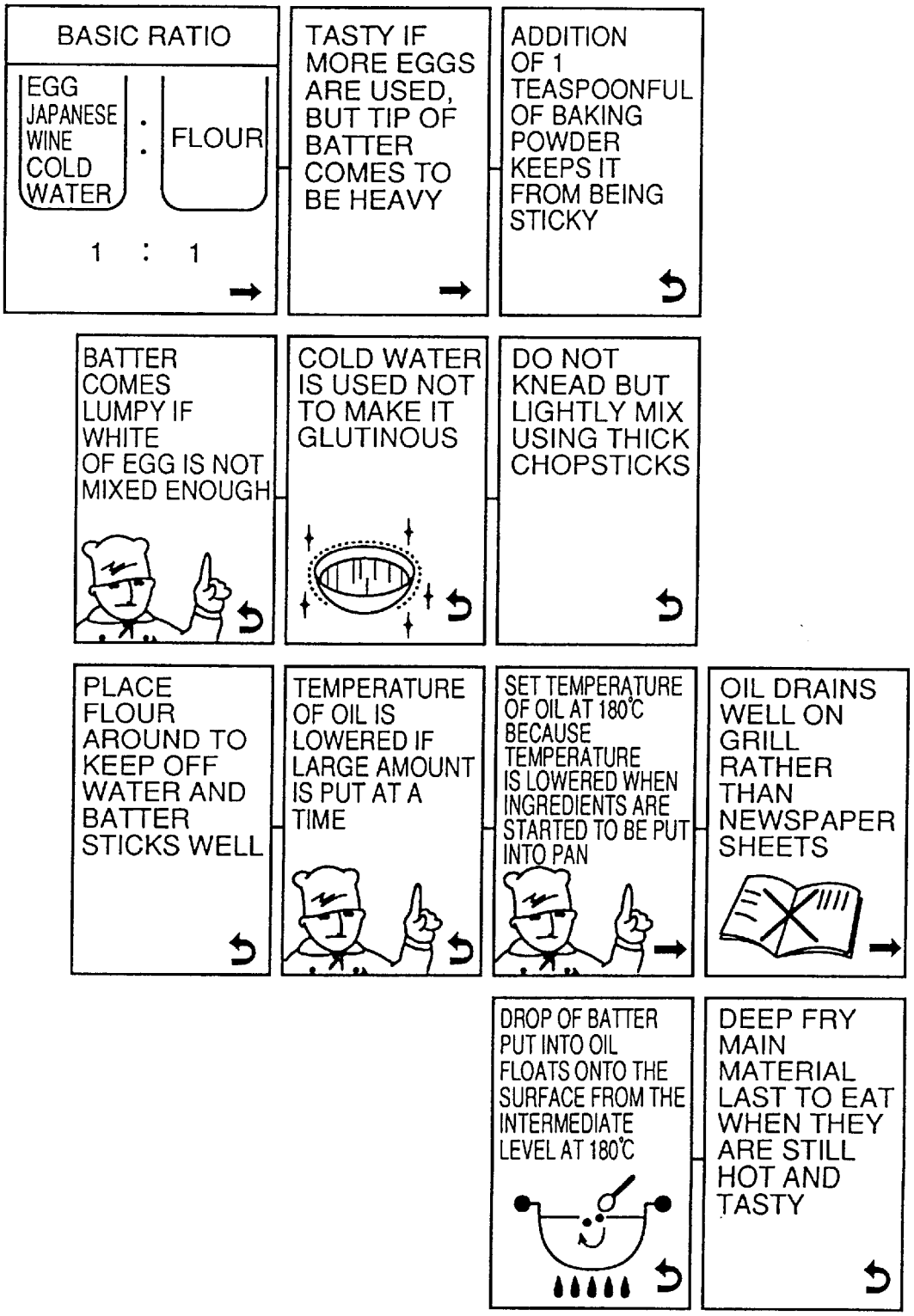

FIGS. 22A and 22B show contents displayed when the user selects "COOKING MEMOS" from the usual cooking mode, and then the basics of "TENPURA" from "HINTS FOR DEEP FRYING".

Thus, in the "USUAL" cooking mode, by pressing chef key 16, convenient information such as cooking hints is available. Also in this mode, whether it is related to microwave oven cooking or not, convenient cooking information may be displayed, necessary information is available at the moment without bringing out a cooking book from time to time during cooking.

(5) Initialization

Figure 23:
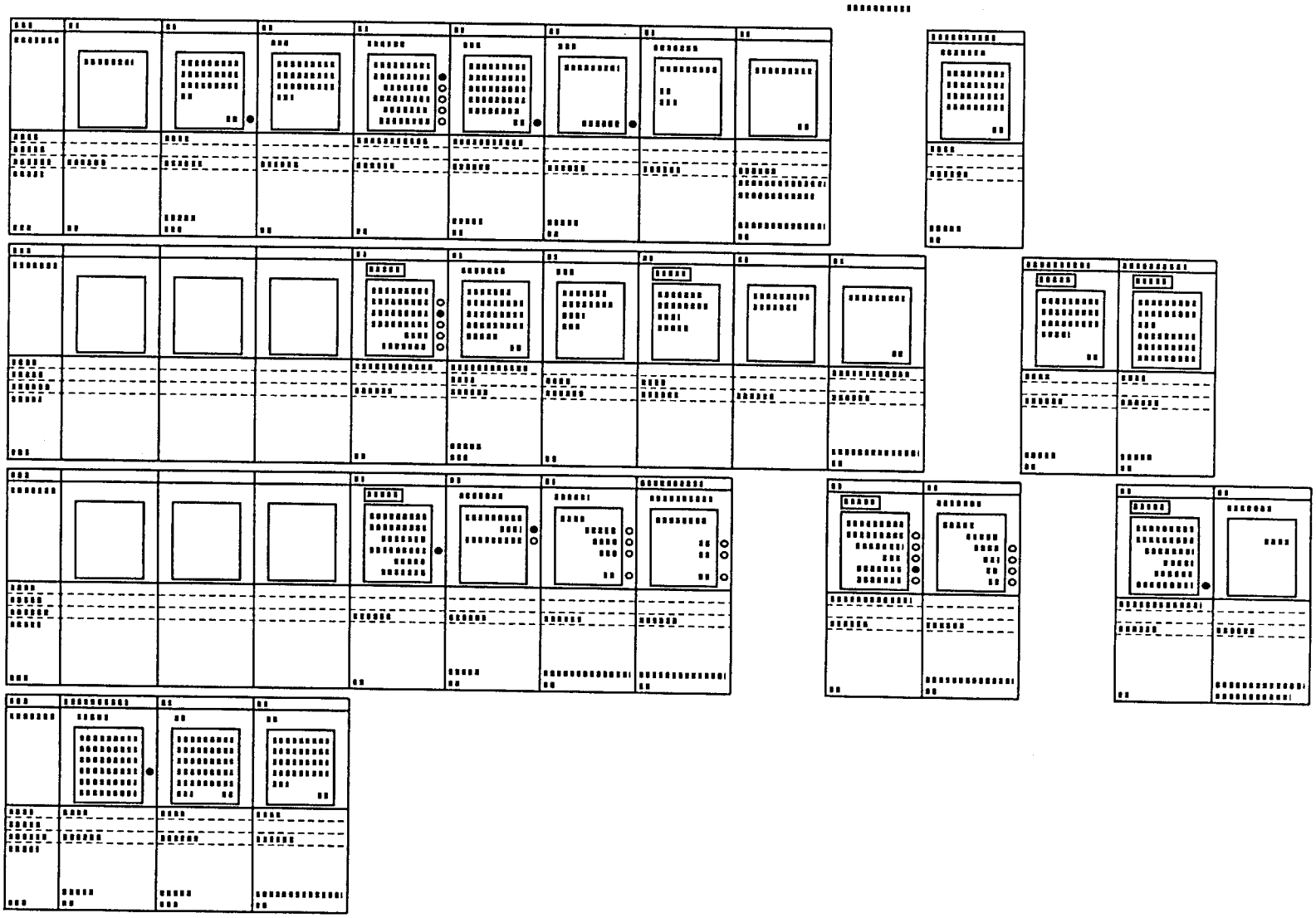
FIG. 23 shows an example of content on the display of the cooking apparatus according to the invention during initialization.

Once the power supply of the microwave oven according to this embodiment is turned on, display data related to initialization stored in external memory 7 is read out by microcomputer 1 and displayed on liquid crystal display 9 through display control circuits 8. FIG. 23 corresponds to the contents of initialization displayed, in other words image No. 1 is displayed at the moment the power supply is on, and then switched to image No. 2 in a few seconds.

In image No. 2, "PRESS CHEF KEY FOR FIRST TIME USE" is displayed, and if the user presses chef key 16 as instructed, image No. 4 is displayed. The displayed items include how to adjust a weight sensor necessary to cope with impact during the delivery of the microwave oven, how to initially heat the oven without a food material for removing the smell, how to adjust the volume of the sound or the contrast of the display, and how to set time. They do not have to be conducted but are effective in aiding the user to more conveniently use the microwave oven. They can be readily initialized in interaction with the displayed images.

(6) Clearly Indicating Start of Heating

According to the invention, if heating should be interrupted a number of times for inbetween processing such as the case of cooking a cream puff described as an example of the automatic cooking mode, the user is clearly informed thereof, and the image asking the user to operate start key 20 is displayed from time to time depending on the necessity in the series of operations.

Figure 24A:
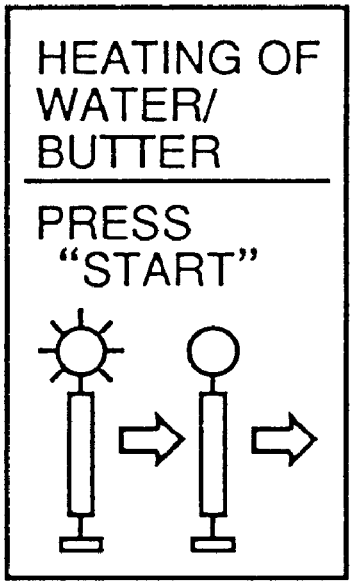
FIGS. 24A and 24B show contents on the display of the cooking apparatus according to the invention when heating is started.
Figure 24B:
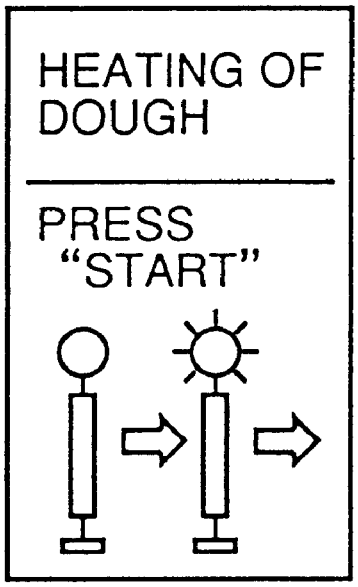

For example, during making the cream puff, illustrations to clearly informing the number of heating stages are displayed in image Nos. 36 and 42 in FIGS. 9A and 9B. FIGS. 16A and 16B show an example of the content, by illustration of bus stops. FIG. 24A is a pattern displayed in image No. 36, the head of the first bus stop is flashed, indicating the start of heating water and butter. Meanwhile, FIG. 24B shows a pattern displayed in image No. 42, the head of the second bus stop is flashed, indicating the start of heating of dough.

Information Sound Generator

Figure 51:
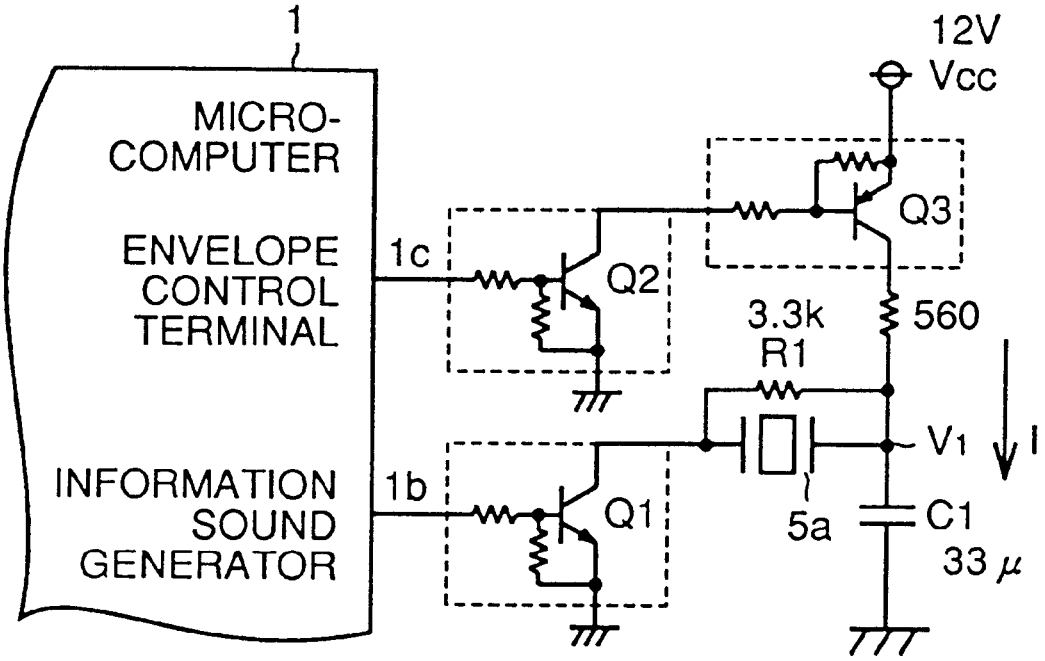
FIG. 51 is a diagram showing the circuit of an information sound generator in the cooking apparatus according to the invention.

Now, an information sound generator according to the invention will be described. FIG. 51 is a diagram showing the electrical circuit of information sound generator 5, which outputs various melodies which remind the user of various contents displayed on liquid crystal display 9.

In FIG. 51, microcomputer 1 includes an information sound output terminal l*b* and an envelope control terminal l*c*, and information sound output terminal l*b* repeats alternately outputting a high level and a low level. A transistor Q1 repeatedly turns on and off, and an information sound is output from a piezoelectric buzzer 5*a*. Capacitor C1 is sufficiently charged, and piezoelectric buzzer 5*a* does not operate unless terminal voltage V1 between the earth side terminal and the opposite side terminal goes a high level.

As described above, when a high level and a low level are alternately repeatedly output from information sound output terminal l*b* and a signal is output from envelope control terminal l*c*, transistor Q2 is turned on, which turns on transistor Q3. As a result, current I is passed to sufficiently charge capacitor C1, and terminal voltage V1 attains a high level, thus operating piezoelectric buzzer 5*a* to output an information sound.

Figure 52:
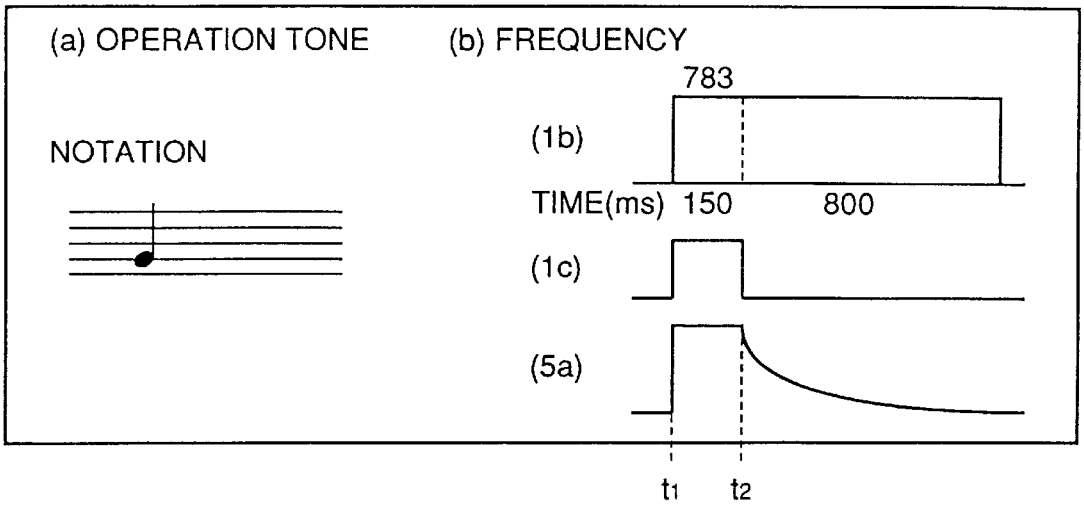
FIG. 52 shows the relation between an operation sound and the output terminal signal of the information sound generator, a microcomputer output signal and the output waveform of the information sound generator.
Figure 53:
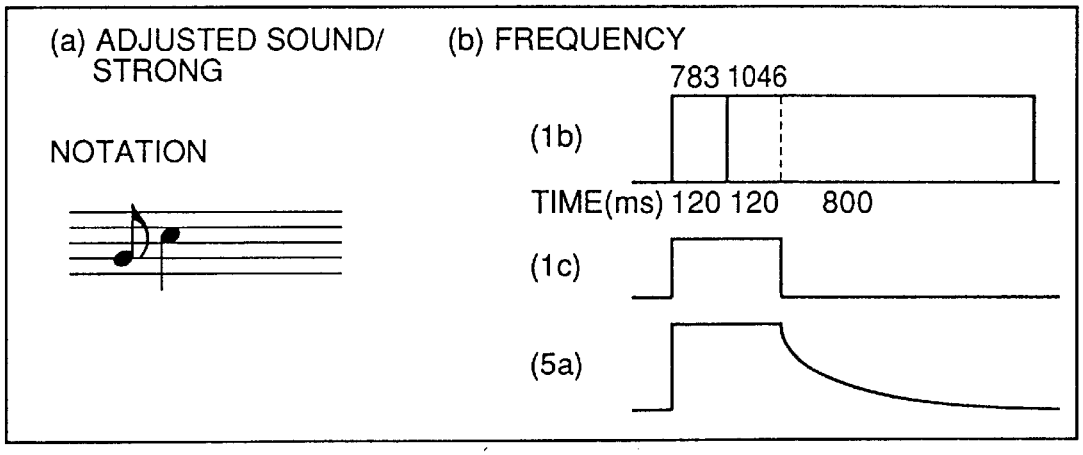
FIG. 53 shows the relation between an adjusted sound and the output terminal signal of the information sound generator, a microcomputer output signal and the output waveform of the information sound generator.

FIGS. 52A and 52B show the output waveforms of information sound output terminal 1*b*, envelope control terminal 1*c* and piezoelectric buzzer 5*a* when an operation tone (so) is output. FIGS. 53A and 53B show the output waveforms when adjusting tones (so, do) are output. As far as a high level signal is output from envelope control terminal l*c*, piezoelectric buzzer 5*a* outputs an information sound, but once envelope control terminal 1*c* outputs a low level sound, and since then the operation is gradually attenuated to gradually reduce the level of information sound.

As can be seen from these figures, the frequency is different between tones. In this example, the tone (so) is at 783 Hz, and the tone (do) is at 1046 Hz.

FIG. 54 shows melodies corresponding to tones informing the user of operation, start, canceling, hints and the end of heating, the waveforms and frequencies of the tones, and time. In microcomputer 1, a main routine is circulated once in one cycle of the frequency of the power supply. In other words, the frequency data of a tone can be set once for one cycle of the power supply frequency. As shown in FIG. 54, when a melody is output, the time interval to switch the frequency is 100 ms or higher, which is longer enough than the power supply frequency (60 Hz:16.70 ms, 50 Hz:20 ms) and switchable.

Conventional microwave ovens have a high information tone, which may sound uncomfortable, particularly for aged users. Therefore, for the melodies, tones in the range from 500 Hz to 1 KHz is used. In addition, in order to improve the high pitched tone caused by operating the piezoelectric buzzer with a rectangular wave output from the microcomputer, an envelope control signal is output from another terminal of the microcomputer. The signal charges/discharges the capacitor, which rounds off the rectangular wave at the switching of the frequency or at the end of a melody, and effectively modifies the sound as described in detail.

Checking System of Microwave Oven

Now, the checking system of a microwave oven will be described. Since above-described microwave oven has a system to control extremely complicated display contents or sounds, it is critical to analyze display contents and sound contents accurately and at a high speed in order to improve the checking precision.

In the system according to the invention, minimum checking data needed on the side of a checking device such as display contents, melody patterns, and control contents are constantly output from the microwave oven side in the process of a usual program by the operation of microcomputer 1 in the microwave oven. In order to minimize the number of output terminals in microcomputer 1 necessary for the data, a checking device capable of serially transferring the data is provided.

Figure 55:
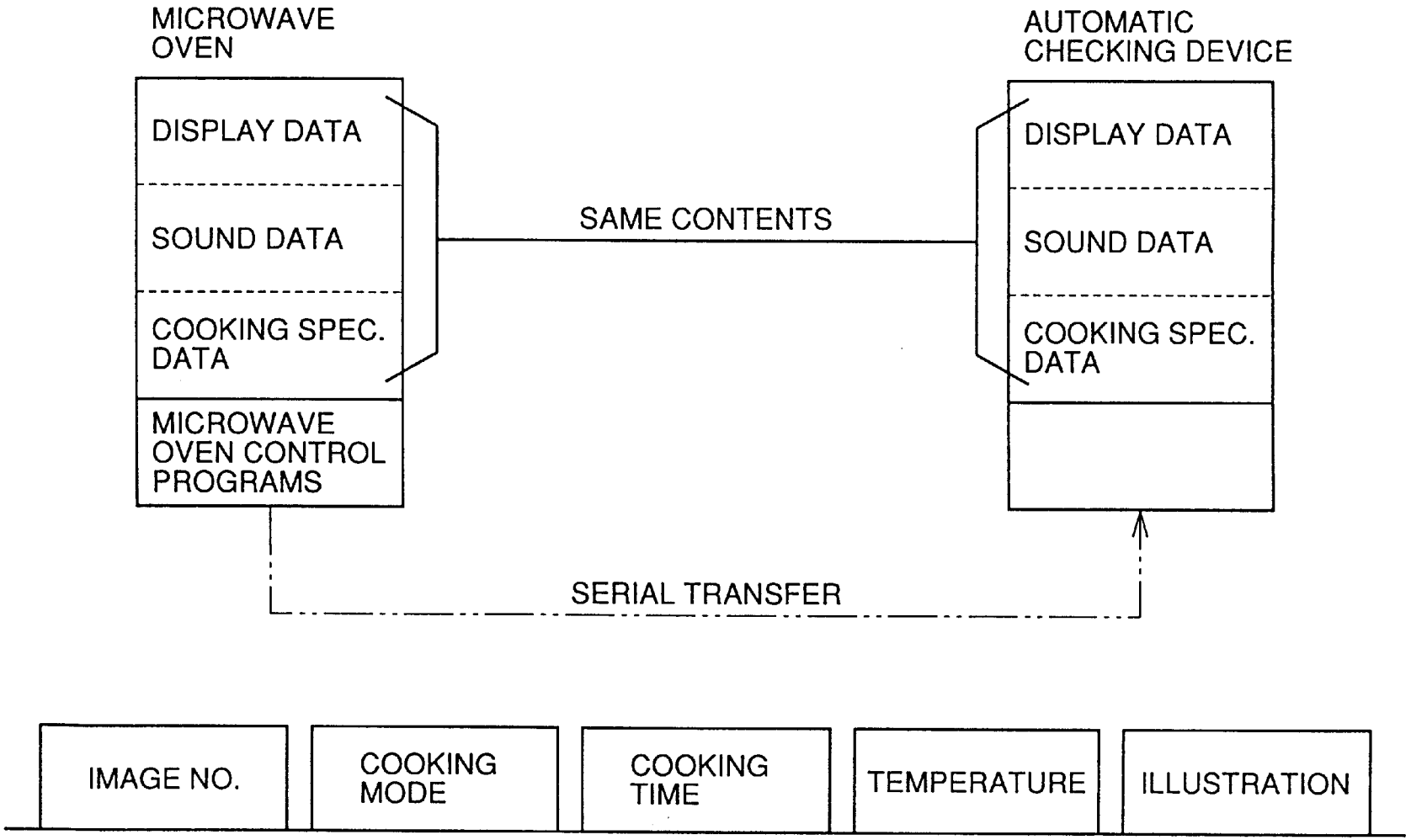
FIG. 55 is a diagram schematically showing the relation of storage data between the side of a microwave oven and the side of a checking device in a checking system in the cooking apparatus.

According to the present system, display data is stored together with image numbers in external memory 7 as described above. Therefore, various data such as cooking time data is superposed on a basic image to complete the image. More specifically, if an image number and superposed data are known, and the same display data as the microwave oven is available on the checking device side, the display image can be reproduced. The checking device determines if display information available from the microwave oven coincides with each operation as described in FIG. 55.

However, prior to checking, it should be previously confirmed if data related to display contents and information sounds by the microwave oven coincides with the corresponding data on the checking device side or the content of each display image should be confirmed previously.

Figure 56:
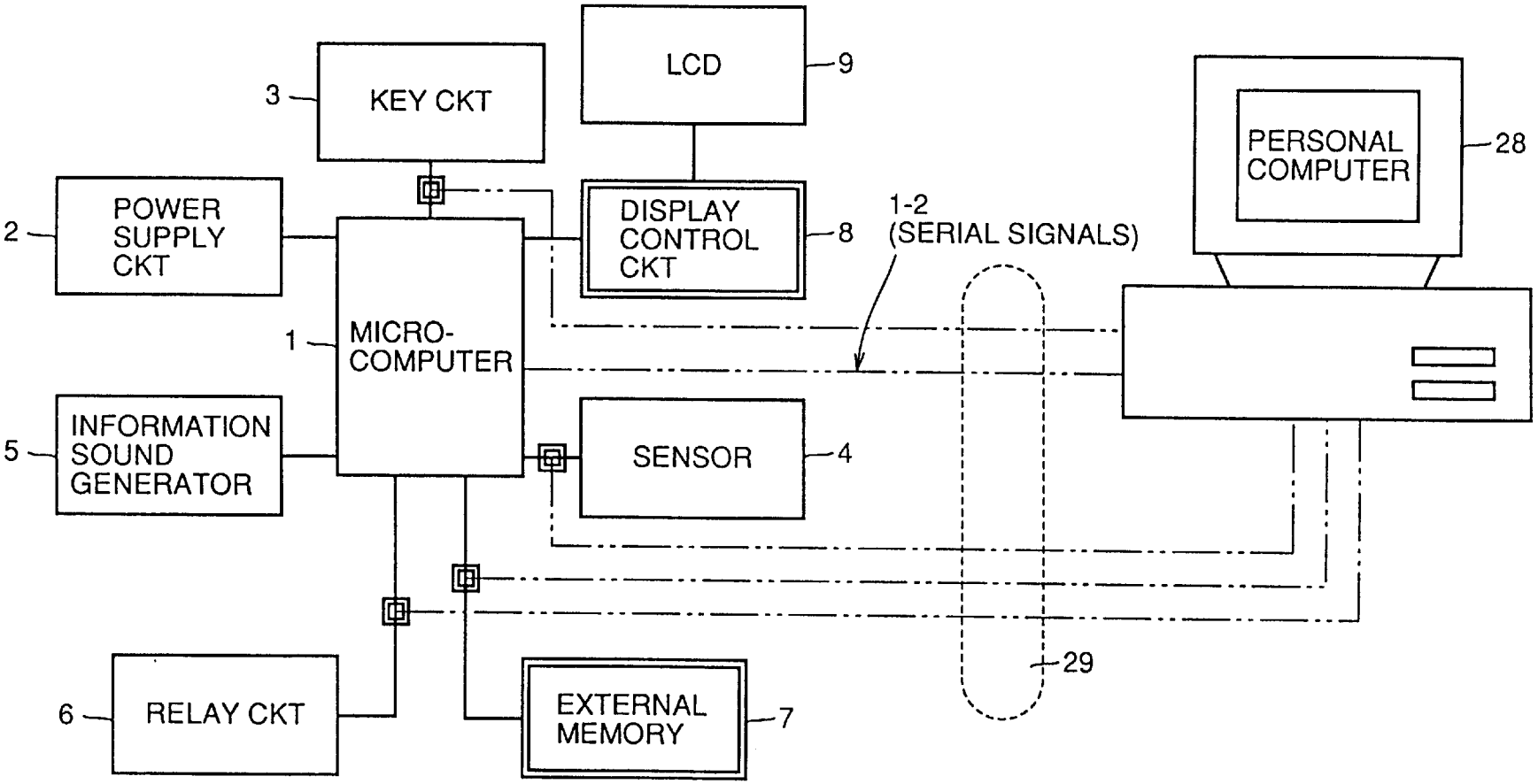
FIG. 56 is a block diagram showing the configuration of the checking system in the cooking apparatus.

Referring to FIG. 56, a data input/output signal line 29 connects checking device 28 and the control circuit. More specifically, key circuit 3, the signal input/output line of microcomputer 1 and checking device 28 are connected, microcomputer 1 and checking device 28 are connected, a sensor 4, the signal input/output line of microcomputer 1 and checking device 28 are connected, external memory 7, the signal input/output line of microcomputer 1 and checking device 28 are connected, a relay circuit 6, the signal input/output line of microcomputer 1 and checking device 28 are connected, and various kinds of data are supplied to checking device 28.

Figure 57:
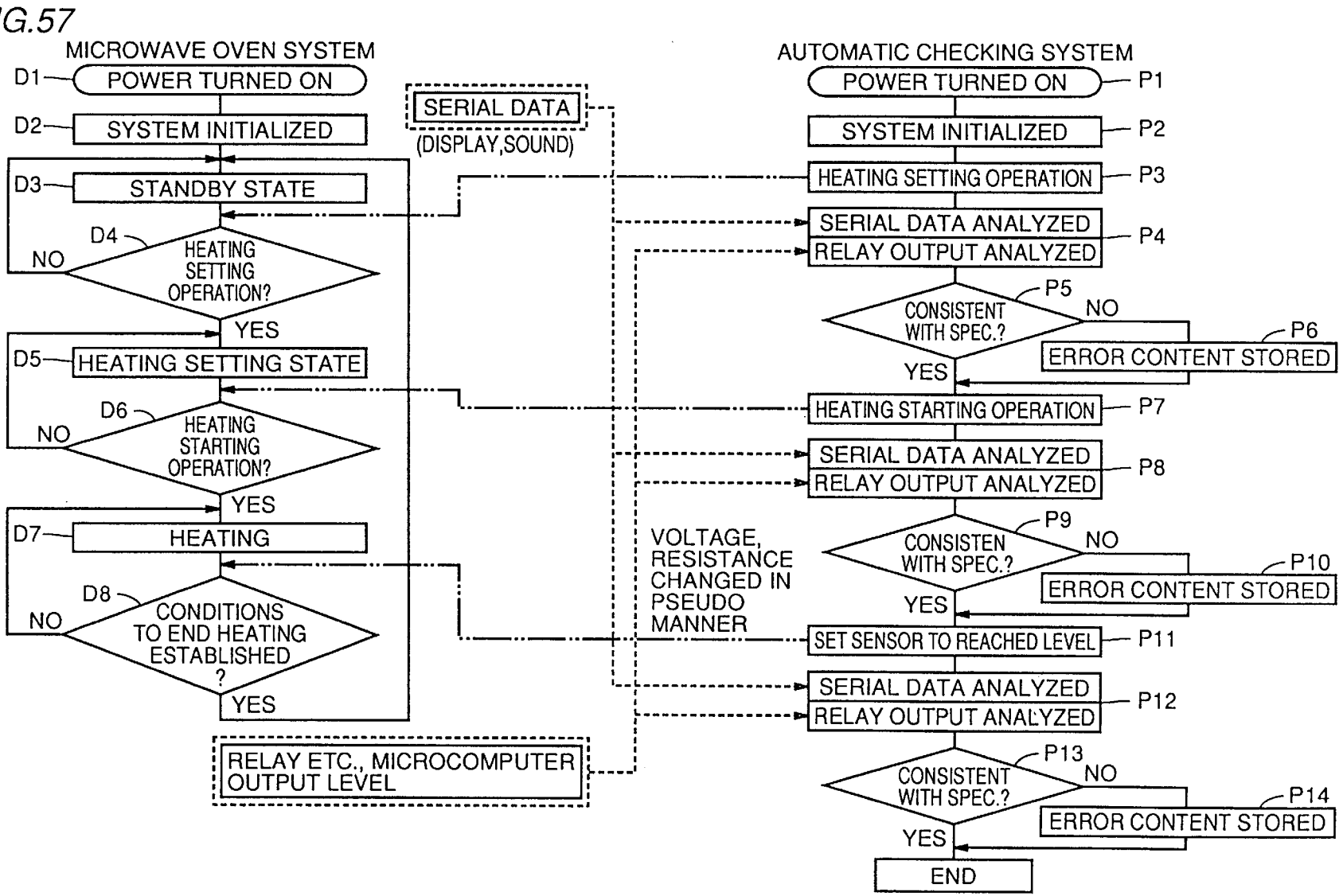
FIG. 57 is a flow chart for use in illustration of checking by the checking system in the cooking apparatus.

Referring to FIG. 57, once the power supply is on (step D1), the microwave oven initializes the system (step D2), and attains a standby state (step D3).

Meanwhile, checking device 28 proceeds to step P3 of operations for setting heating after the turning on of the power supply (step P1) and the initialization of the system (step P2), and performs a pseudo key operation by electrically short-circuiting the key switch of the microwave oven to determine a dish to cook.

By this operation, the microwave oven enters the state of operations for setting heating (steps D4 and D5), and outputs a key input sound the moment the image of liquid crystal display 9 changes to the image for setting heating. The microwave oven constantly outputs data related to the display and information sounds from the output terminal of microcomputer 1. Checking device 28 then reads the serial data and the output levels of relay, and determines if they coincide with the specification (steps P4 and P5). If no coincidence is found in the determination, the content of inconsistency generated in the checking items provided for the microwave oven is automatically stored in a recording medium (such as floppy disk) in the checking device 28 (step P6).

Once the inconsistency is stored, or the operation of the state for setting heating (including display and information sounds) is in coincidence with the specification, the process proceeds to the next checking. As the next checking, the key switch of the microwave oven is electrically short-circuited in order to initiate heating, and heating is initiated by a pseudo start key operation (step P7).

By this operation, the microwave oven attains a heating state (steps D6, D7), and outputs a key input sound the moment the displayed image changes to the image of the state of heating. At the time, checking device 28 reads serial data and the output levels of the relay, and determines if they are in coincidence with the specification (steps P8, P9). If no coincidence is found in the determination, the content of inconsistency generated in the checking items provided for the microwave oven is automatically stored in a recording medium (such as floppy disk) in checking device 28 (step P10).

Once the content of inconsistency is stored or the operation of the state of heating (including display contents and information sounds) coincides with the specification, the process proceeds to the next checking. As the next checking, the voltage and resistance value are electrically changed by checking device 28 with respect to the sensor of the microwave oven which determines the end of automatic cooking (step P11). By this operation, the microwave oven completes heating (step D8), returns to the standby state (step D3), and outputs the completion sound the moment the image on liquid crystal display 9 changes to the image of the standby state.

Meanwhile, checking device 28 reads serial data and the output levels of the relay from the microwave oven and determines if they are coincides with the specification (steps P12 and P13). If they are not in coincidence with the specification, the checked item of the microwave oven and the content of inconsistency are automatically stored in a recording medium (such as floppy disk) in checking device 28 (step P14). Once the inconsistency or the like are stored or if serial data and the outputs of the relay are incoincidence with the specification, the checking completes. The checking is conducted to all the cookings and all the operations by the microwave oven. The stored contents of inconsistencies are analyzed for confirmation after the completion of all the checkings, and an appropriate measure will be taken.

Television Display System

If images displayed on the display of a cooking device such as microwave oven or the sounds therefrom can be reproduced by an externally provided monitor television, the images or sounds may be used for sales presentations or advertisements of products at distributors' shop fronts. In this system, in order to cope with such a demand, data inside the microcomputer can be serially transferred as is the above checking system as will be described in more detail.

Figure 58:
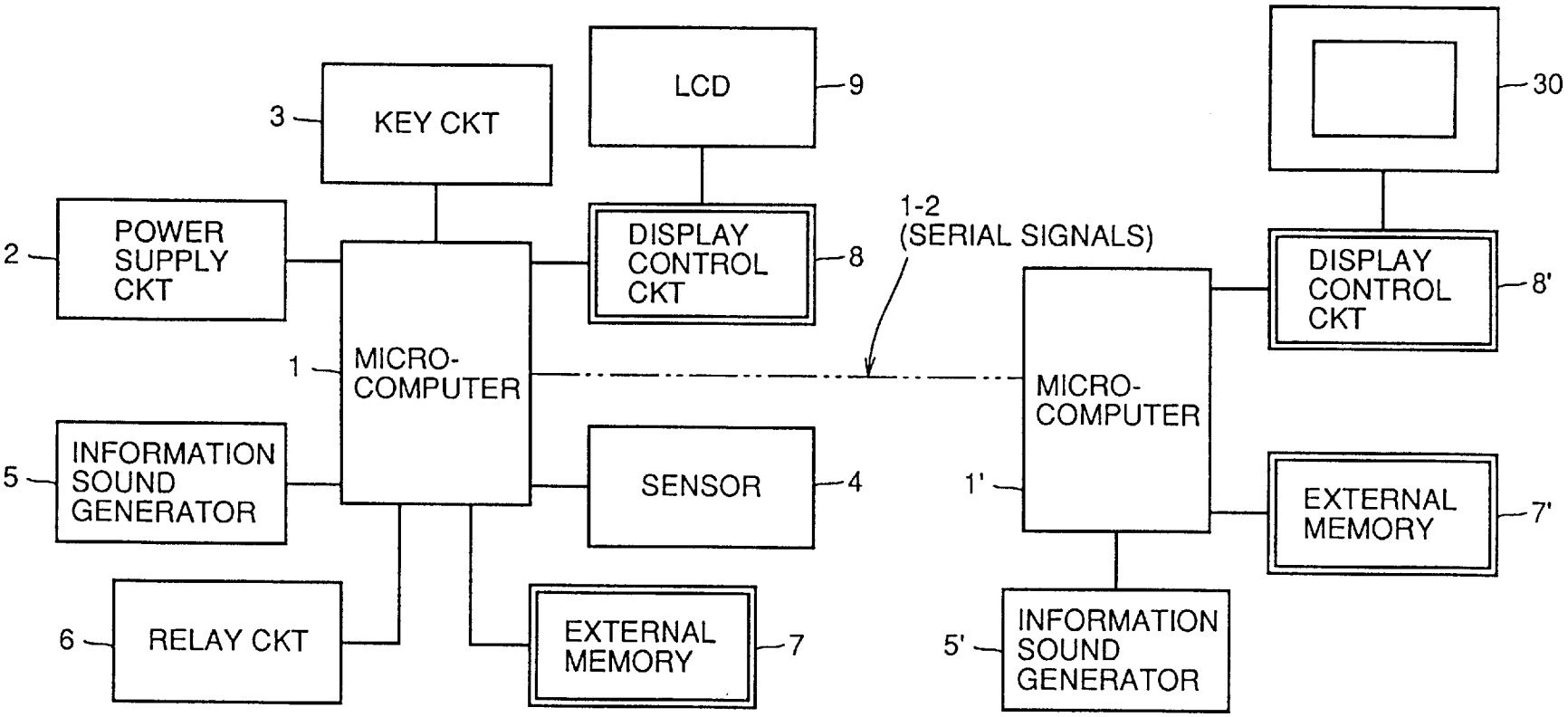
FIG. 58 is a block diagram showing the configuration of a television display system in the cooking apparatus.

Referring to FIG. 58, a microcomputer 1' for television display is connected to a monitor television 30 through a display control circuit 8'. An external memory 7' and an information sound generator 5' are also connected to microcomputer 1'. Information sound generator 5' may be built in a monitor television 30. Microcomputer 1 on the side of the microwave oven is connected with microcomputer 1' for television display, and control information inside microcomputer 1 is serially output as data to microcomputer 1'.

The same data as data related to display images and information sounds in external memory 7 on the side of the microwave oven is previously stored in an external memory 7' for television display. The data related to display images and information sounds corresponding to control information available from microcomputer 1 is read out from external memory 7' by microcomputer 1' and transmitted to display control circuit 8' and information sound generator 5'. Thus, the displays and sounds output on the side of the microwave oven can be reproduced by monitor television 30 and information sound generator 5'.

Note that the output terminal of microcomputer 1 used may be the same as that used for the above-described checking system. External memory 7' may be a flash memory, and data related to all the displays and information sounds on the side of the microwave oven during the above reproducing process. Furthermore, by the function of display control circuit 8', the size of the image displayed on monitor television 30 may be switched. In addition, data related to original images and information sounds may be stored in external memory 7', and images of different patterns from those on the side of the microwave oven may be made.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cooking apparatus, comprising:

storage means for storing methods of cooking various dishes;

specifying means for specifying one out of a plurality of large groups of cooking methods produced by classifying the cooking methods stored in said storage means depending on a kind of cooking;

display means for switching to items corresponding to the one group of cooking methods specified by said specifying means and displaying the switched items;

selecting means for selecting one out of the items corresponding to the one group of cooking methods displayed by said display means; and control means for controlling a cooking operation based on the item selected by said selecting means.

2. The cooking apparatus as recited in claim 1, wherein said storage means previously stores information for explaining cooking methods, and said display means extracts information for explaining a cooking method corresponding to the item selected by said selecting means from said storage means and displays the extracted information.

3. The cooking apparatus as recited in claim 2, further comprising start instruction means for instructing said cooking operation to start, wherein said display means extracts necessary information for explaining said cooking method until the start of said cooking operation and displays the extracted information, and said control means starts said cooking operation when the start of the cooking operation is instructed by said start instruction means.

4. The cooking apparatus as recited in claim 3, wherein said display means does not display information for explaining said cooking method after the start of the cooking operation is instructed by said start instruction means.

5. The cooking apparatus as recited in claim 2, further comprising undesired part storage means for storing an undesired part of the finished state of a dish by the corresponding cooking method, wherein said display means extracts an undesired part in the previous corresponding cooking method from said undesired part storage means at the time of displaying information for explaining said cooking method and displays a cause of the extracted undesired part and an advice.

6. The cooking apparatus as recited in claim 2, wherein said storage means previously stores animated information for explaining a cooking method, and said display means displays said animated information at the time of displaying information for explaining said cooking method.

7. The cooking apparatus according to claim 6, further including means for producing sound related to said animation.

8. The cooking apparatus as recited in claim 1, wherein if a prescribed group is specified by said specifying means, said display means displays display data for explaining a cooking method corresponding to said prescribed group in words easy to understand.

9. The cooking apparatus as recited in claim 1, wherein said storage means previously stores hint information on said various dishes, and if said selecting means selects a prescribed item, said display means extracts hint information on said dish corresponding to said prescribed item from said storage means and displays the extracted hint information.

10. The cooking apparatus as recited in claim 1, wherein said storage means previously stores information on cooking procedures of said various dishes, said display means sequentially displays information on said cooking procedure corresponding to the item selected by said selecting means, and said control means sequentially controls a cooking operation corresponding to the item selected by said selecting means.

11. The cooking apparatus as recited in claim 10, further comprising display instruction means whose background illumination flashes on and off in a prescribed stage for instructing display of hint information, wherein said storage means previously stores hint information on said various dishes, and said display means extracts said hint information from said storage means and displays the extracted hint information if the background illumination of said display instruction means flashes on and off and the display of the hint information is instructed.

12. The cooking apparatus as recited in claim 10, wherein said storage means previously stores display data for illustrations, and said display means displays said illustrations as well when sequentially displaying the information on said cooking procedure corresponding to the item selected by said selecting means.

13. The cooking apparatus as recited in claim 1, further comprising information sound generation means for outputting an information sound depending upon a content displayed by said display means and a cooking operation by said control means.

14. The cooking apparatus as recited in claim 1, further comprising information sound generation means for outputting an information sound of a melody corresponding to an item selected by said selecting means.

15. The cooking apparatus as recited in claim 1, wherein said display means has different background colors based on whether or not said control means is in a process of the cooking operation.

16. A cooking method using a cooking apparatus sequentially displaying cooking methods, comprising the steps of receiving an instruction to specify one out of a plurality of large groups produced by classifying cooking methods based on a kind of cooking;

switching to items corresponding to said specified one group of cooking methods and displaying the switched items;

receiving an instruction to select one out of the items corresponding to said displayed one group of cooking methods; and controlling a cooking operation based on said selected item.

17. A cooking apparatus, comprising:

means for storing methods of cooking various types of food;

means for specifying one out of a plurality of large groups of cooking methods produced by classifying the cooking methods stored in said storage means depending on a kind of cooking;

means for switching to items of food corresponding to the one group of cooking methods specified by said means for specifying and displaying the switched items;

means for selecting one out of the items of food corresponding to the one group of cooking methods displayed by said means for displaying;

means for determining the specific materials of food to produce the one item of food; and means for controlling a cooking operation based on the item of food selected by said selecting means.

* * * * *